US007766454B2

(12) United States Patent
Mori

(10) Patent No.: US 7,766,454 B2
(45) Date of Patent: Aug. 3, 2010

(54) LIQUID DISCHARGE HEAD, LIQUID DISCHARGER, AND IMAGE FORMING APPARATUS, INCLUDING SILICONE RESIN LAYER FORMED ON DISCHARGE SIDE OF HEAD

(75) Inventor: Takashi Mori, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 580 days.

(21) Appl. No.: 11/787,705

(22) Filed: Apr. 16, 2007

(65) Prior Publication Data

US 2007/0242107 A1 Oct. 18, 2007

(30) Foreign Application Priority Data

Apr. 18, 2006 (JP) ..... 2006-114092
Feb. 26, 2007 (JP) ..... 2007-046234

(51) Int. Cl.
*B41J 2/135* (2006.01)

(52) U.S. Cl. ..... 347/45; 347/68; 347/70

(58) Field of Classification Search ..... 347/20, 347/44, 45, 57, 61–65, 67, 68, 70–72
See application file for complete search history.

(56) References Cited

U.S. PATENT DOCUMENTS 5,218,381 A 6/1993 Narang et al.
5,443,687 A * 8/1995 Koyama et al. ..... 216/27
6,598,957 B2 * 7/2003 Yamamoto et al. ..... 347/45
7,025,453 B2 * 4/2006 Ylitalo et al. ..... 347/105
2006/0115598 A1 6/2006 Kaneko et al.
2007/0115323 A1 5/2007 Mori

FOREIGN PATENT DOCUMENTS

EP 1666258 A2 6/2006
EP 1790477 A1 5/2007
JP 3379119 12/2002
JP 2003-19803 1/2003
JP 2003-72085 3/2003
JP 2005-138383 6/2005
JP 3755647 1/2006

OTHER PUBLICATIONS

U.S. Appl. No. 11/592,386, filed Nov. 2, 2006.
Sep. 1, 2008 search report in connection with a counterpart European patent application No. 07 25 1634.

* cited by examiner

*Primary Examiner*—Juanita D Stephens
(74) *Attorney, Agent, or Firm*—Cooper & Dunham LLP

(57) ABSTRACT

A liquid discharge head configured to discharge liquid is disclosed that includes a silicone resin layer formed on the side of a surface from which the liquid is discharged. The silicone resin layer serves as a water-repellent layer. The number of water-repellent molecular chains is greater than or equal to half of the number of hydrophilic molecular chains on the surface of the silicone resin layer, and the number of hydrophilic molecular chains in the silicone resin layer is greater on the side of the interface with a base material on which the silicone resin layer is formed than on the surface of the silicone resin layer.

19 Claims, 8 Drawing Sheets

LIQUID DISCHARGE HEAD, LIQUID DISCHARGER, AND IMAGE FORMING APPARATUS, INCLUDING SILICONE RESIN LAYER FORMED ON DISCHARGE SIDE OF HEAD

BACKGROUND

1. Technical Field

This disclosure relates generally to liquid discharge heads, liquid dischargers, and image forming apparatuses, and more particularly to a liquid discharge head having a water-repellent layer at a surface, a liquid discharger including the liquid discharge head, and an image forming apparatus including the liquid discharge head.

2. Description of the Related Art

Some of the image forming apparatuses such as printers, facsimile machines, copiers, and those having two or more of the functions of these apparatuses perform image forming (recording or printing) by causing recording liquid (hereinafter also referred to as "ink") as liquid to adhere to a medium (hereinafter also referred to as "paper" or "paper sheet," but not limited to paper in material; "medium to be subjected to recording," "recording medium," "transfer material," and "recording paper" may also be used as synonyms) while conveying the paper, using, for example, a liquid discharger (liquid discharge device) including a recording head formed of a liquid discharge head that discharges liquid droplets of the recording liquid.

The term "image forming apparatus" means an apparatus that performs image forming by discharging liquid onto media such as paper, thread, textile, cloth, leather, metal, plastic, glass, wood, and ceramics. The term "image forming" means not only providing media with significant images such as letters, characters, and figures, but also providing media with insignificant images such as patterns. Further, the term "liquid" is not limited to recording liquid and ink, and may be any liquid as long as images can be formed with it. Further, the term "liquid discharger" means an apparatus that discharges liquid from a liquid discharge head.

The liquid discharge head performs recording by causing liquid droplets to be discharged from nozzles. Accordingly, the nozzle shape and accuracy greatly affect its ink droplet ejection characteristics. Further, it is known that the surface characteristics of a nozzle formation member in which nozzle holes are formed also affect the ink droplet ejection characteristics of the head. For example, it is known that if ink adheres to the fringe of a nozzle hole on the surface of the nozzle formation member so that a non-uniform ink pool is formed, various problems are caused. For example, ink droplets are discharged in curved directions, variations are caused in ink droplet size, and the flying velocity of ink droplets becomes unstable.

Therefore, in common liquid discharge heads, an ink-repellent layer (film) or a water-repellent layer is formed at the surface on the liquid droplet discharging side. For example, in addition to forming a fluorine-based water-repellent film as a water-repellent layer, forming an ink-repellent layer of a compound having a perfluoropolyether chain and an alkoxysilane residue is disclosed in Japanese Laid-Open Patent Application No. 2003-019803, forming a water-repellent film of a fluororesin polymerization film or a silicone resin polymerization film is disclosed in Japanese Patent No. 3755647 (corresponding to Japanese Laid-Open Patent Application No. 2003-72086), and forming a water-repellent film of a silicone resin layer by electrostatic painting is disclosed in Japanese Laid-Open Patent Application No. 2005-138383.

Further, as a method of forming a water-repellent film, Japanese Patent No. 3379119 discloses applying a water and oil repellent film on a nozzle surface by dipping the nozzle surface in a solution in which a water and oil repellent material is dissolved while keeping gas emitted from the nozzle bottom side to the nozzle surface; thereafter removing the nozzle surface from the solution while emitting the gas; and then leaving the nozzle surface.

In recent image forming apparatuses, various modifications have been made to the composition of recording liquid (ink) in order to form a high-quality image on plain paper in particular. Characteristics required as recording liquid include color tone, image density, and bleeding for achieving high quality; the dissolution or dispersion stability of a coloring agent in recording liquid, storage (preservation) stability, and discharge stability for achieving reliability; water resistance and light fastness for ensuring the keeping quality of a recorded image; and the quick drying of recording liquid for achieving high speed.

For example, at the beginning, dye inks using dye as a coloring agent were the mainstream of recording liquid because of their good color development and high reliability. In these years, however, ink compositions using pigment such as carbon black have been used in order to provide recorded images with light fastness and water resistance. Further, some recording liquids use fluorochemical (a fluorochemical or fluorine-containing surfactant) as a surfactant added as a recording liquid component. Further, in terms of the viscosity of recording liquid, it is necessary to use highly viscous ink in order to ensure high-speed printing on plain paper with high printing quality.

Specifically, with respect to conventional liquid discharge heads using fluororesin for a water-repellent layer, a method that forms a PTFE thin film on the surface of a metal nozzle plate by Ni-PTFE eutectoid plating and heat treatment thereon and a method that coats the surface of a metal or resin nozzle plate (base material) with a fluorochemical water-repellent agent are adopted.

Such nozzle formation members using fluororesin for a water-repellent layer can have good water repellency (ink repellency) with respect to known dye inks and pigment inks (using pigment as coloring material) having surface tensions exceeding 30 mN/m.

According to experiments conducted by the inventor of the present invention, however, it has been confirmed that there is a problem in that sufficient water repellency (ink repellency) does not appear in the case of using inks having a low surface tension of 30 mN/m or less and, in particular, in the case of using inks having fluorochemical added thereto.

As a result of studies for improving water repellency to inks having a low surface tension of 30 mN/m or less and inks having fluorochemical added thereto, it has been found that a silicone resin coating is effective as a water-repellent layer as is also disclosed in Japanese Laid-Open Patent Application No. 2005-138383 described above. It has also been found, however, that sufficient water repellency cannot be produced with respect to inks having low surface tensions, in particular those of a low surface tension containing a fluorochemical surfactant, by merely forming a silicone resin layer.

SUMMARY

According to an aspect of this disclosure, there are provided a liquid discharge head improved in water repellency in particular to liquid containing fluorochemical, a liquid discharger including the liquid discharge head, and an image forming apparatus including the liquid discharge head.

According to another aspect of this disclosure, there is provided a liquid discharge head configured to discharge liquid including a silicone resin layer formed on a side of a surface from which the liquid is discharged, the silicone resin layer serving as a water-repellent layer, wherein a number of water-repellent molecular chains is greater than or equal to a half of a number of hydrophilic molecular chains on a surface of the silicone resin layer, and the number of the hydrophilic molecular chains in the silicone resin layer is greater on a side of an interface with a base material on which the silicone resin layer is formed than on the surface of the silicone resin layer.

The above-described liquid discharge head has good water repellency in the case of discharging liquid, in particular liquid containing fluorochemical.

According to another aspect of this disclosure, there is provided a liquid discharge head configured to discharge liquid including a silicone resin layer formed on a side of a surface from which the liquid is discharged, the silicone resin layer serving as a water-repellent layer, wherein a number of molecular chains having molecular components of a mass number period of 74 is greater than or equal to a half of a number of molecular chains having molecular components of a mass number period of 60 on a surface of the silicone resin layer, and the number of the molecular chains having the molecular components of the mass number period of 60 in the silicone resin layer is greater on a side of an interface with a base material on which the silicone resin layer is formed than on the surface of the silicone resin layer.

The above-described liquid discharge head has good water repellency in the case of discharging liquid, in particular liquid containing fluorochemical.

According to another aspect of this disclosure, there is provided a liquid discharger configured to discharge a liquid droplet from a liquid discharge head, wherein the liquid discharge head is any of the above-described liquid discharge heads.

According to another aspect of this disclosure, there is, provided an image forming apparatus configured to form an image by discharging a liquid droplet from a liquid discharge head, wherein the liquid discharge head is any of the above-described liquid discharge heads.

Thus, since the above-mentioned liquid discharger and image forming apparatus can include any of the above-mentioned liquid discharge heads, the liquid discharger and the image forming apparatus can excellently perform liquid discharging, in particular, in the case of discharging liquid containing fluorochemical.

BRIEF DESCRIPTION OF THE DRAWINGS

Other aspects, features and advantages will become more apparent from the following detailed description when read in conjunction with the accompanying drawings, in which.

DETAILED DESCRIPTION OF THE PREFERRED EMBODIMENTS

A description is given, with reference to the accompanying drawings, of embodiments of the present invention.

Figure 1:
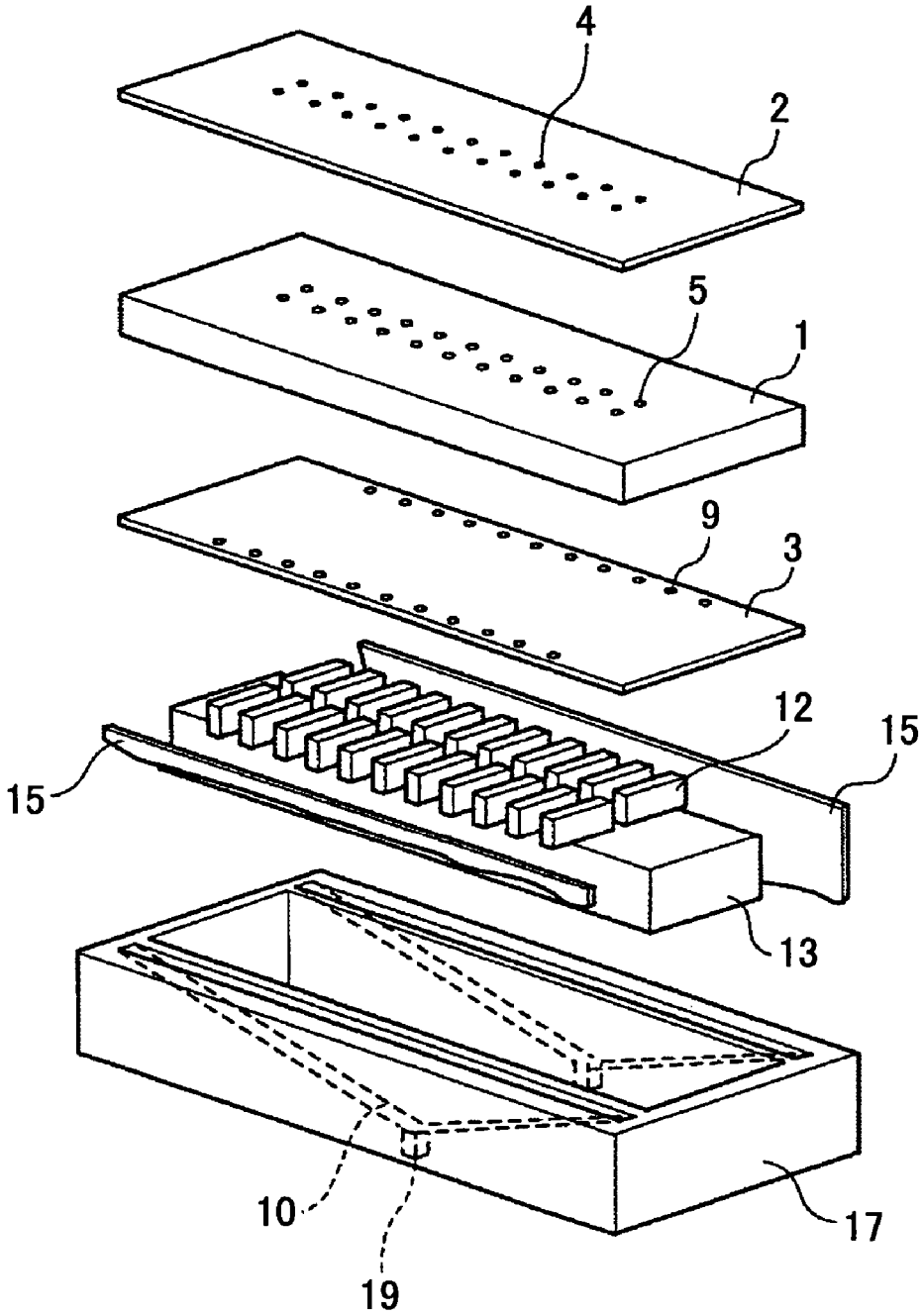
FIG. 1 is an exploded perspective view of a liquid discharge head according to a first embodiment of the present invention.
Figure 2:
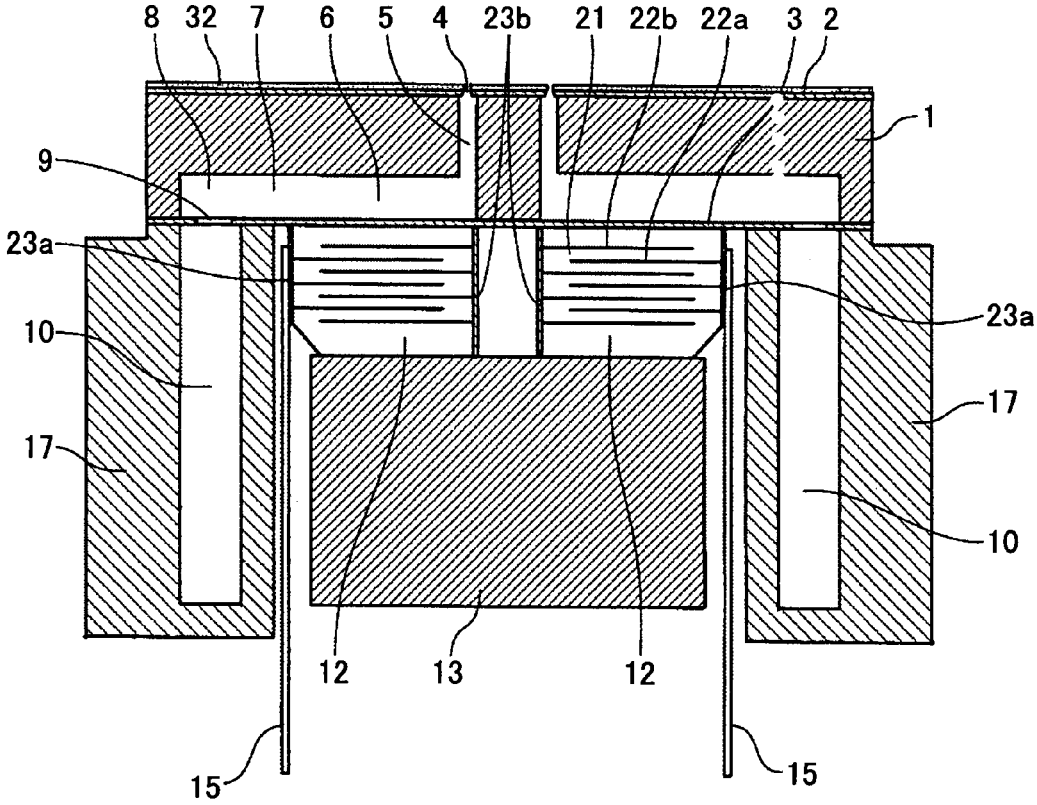
FIG. 2 is a cross-sectional view of the liquid discharge head taken along the length of a pressure liquid chamber thereof according to the first embodiment of the present invention.
Figure 3:
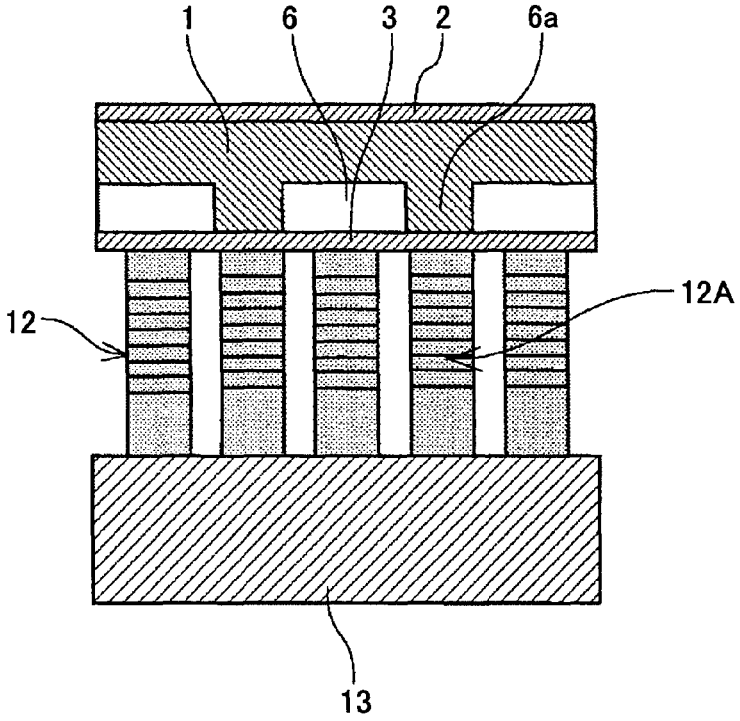
FIG. 3 is a cross-sectional view of the liquid discharge head taken along the width of the pressure liquid chamber thereof where the liquid discharge head has a bi-pitch structure according to the first embodiment of the present invention.
Figure 4:
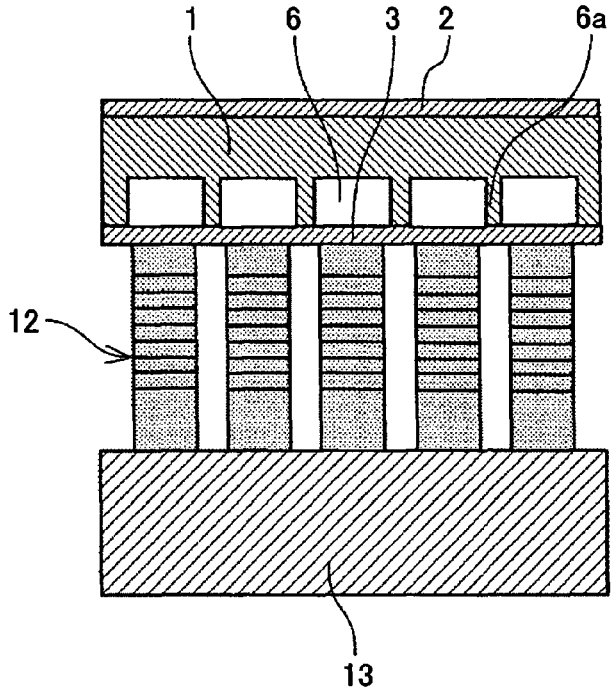
FIG. 4 is a cross-sectional view of the liquid discharge head taken along the width of the pressure liquid chamber thereof where the liquid discharge head has a normal pitch structure according to the first embodiment of the present invention.

First, a description is given, with reference to FIGS. 1 through 4, of a liquid discharge head according to a first embodiment of the present invention. FIG. 1 is an exploded perspective view of the liquid discharge head. FIG. 2 is a cross-sectional view of the liquid discharge head taken along the length of a pressure liquid chamber thereof. FIGS. 3 and 4 are cross-sectional views of the liquid discharge head in different configurations taken along the width of a pressure liquid chamber thereof.

The liquid discharge head includes a channel plate 1, a nozzle plate 2 joined to the upper surface of the channel plate 1, and a diaphragm 3 joined to the lower surface of the channel plate 1, thereby forming pressure liquid chambers 6, fluid resistance parts 7, and communicating parts 8. The pressure liquid chambers 6 communicate with corresponding nozzles 4, through which liquid droplets (droplets of liquid) are discharged, via corresponding communicating paths 5. The communicating parts 8 communicate with the corresponding pressure liquid chambers 6 through the corresponding fluid resistance parts 7. Recording liquid (for example, ink) is supplied from common liquid chambers 10 formed in a frame member 17 described below to the communicating parts 8 through corresponding supply holes 9 formed in the diaphragm 3.

A stacked piezoelectric element 12 serving as a driving element (actuator part or pressure generation part) is provided for each pressure liquid chamber 6 so as to have the upper end face of the piezoelectric element 12 joined, through a connection part (not graphically illustrated) formed in the diaphragm 3, to the outside surface (surface on the side opposite to the pressure liquid chamber 6) of the diaphragm 3 forming a wall face of the pressure liquid chamber 6. Further, each stacked piezoelectric element 12 has its lower end face joined to a base member 13.

Here, each piezoelectric element 12 is a lamination of alternately stacked piezoelectric material layers 21 and internal electrodes 22*a* and 22*b*. The internal electrodes 22*a* and 22*b* are extended to corresponding end faces so as to be connected to end face electrodes (external electrodes) 23*a* and 23*b*, respectively. Displacement is caused in the stacking direction in the piezoelectric element 12 by applying voltages to the end face electrodes 23*a* and 23*b*.

FPC cables 15 are connected to the piezoelectric elements 12 by soldering, ACF (anisotropic conductive film) bonding, or wire bonding in order to provide drive signals to the piezoelectric elements 12. A driver circuit (driver IC) (not graphically illustrated) is provided on each FPC cable 15 so as to selectively apply a driving waveform to each piezoelectric element 12.

In the directions of the width of the pressure liquid chamber 6 (or the directions of arrangement of the nozzles 4), the piezoelectric elements 12 may be arranged alternately with support parts 12A in a bi-pitch structure as shown in FIG. 3, or the piezoelectric elements 12 may be arranged in a normal pitch structure without the support parts 12A as shown in FIG. 4.

In this head, ink in the pressure liquid chambers 6 is pressurized using displacement in the d33 direction as the piezoelectric direction of the piezoelectric elements 12, and liquid droplets are discharged in a side-shooting manner, that is, discharged in a direction different from the direction of flow of the ink (recording liquid) in the pressure liquid chambers 6. As a result of employment of a side-shooting method, the piezoelectric elements 12 are substantially equal in size to the liquid discharge head. Therefore, it is possible to link reduction in the size of the piezoelectric element 12 directly to reduction in the size of the head, which facilitates reduction in the size of the head.

Further, the frame member 17 formed of, for example, an epoxy resin or polyphenylene sulfide by injection molding is joined to the periphery of an actuator portion formed of the piezoelectric elements 12, the base member 13, and the FPC cables 15. The above-described common liquid chambers 10 are formed in the frame member 17. Further, each common liquid chamber 10 has a supply hole 19 for externally supplying recording liquid thereto formed therein.

Each supply hole 19 is connected further to a recording liquid supply source such as a sub-tank or a recording liquid cartridge (not graphically illustrated).

Here, through holes to serve as the communicating paths 5 and the pressure liquid chambers 6 and groove parts to serve as the fluid resistance parts 7 and the communicating parts 8 are formed in the channel plate 1 by subjecting a (110) single-crystal silicon substrate to anisotropic etching using an alkaline etching liquid such as a potassium hydroxide (KOH) aqueous solution. The pressure liquid chambers 6 are separated by corresponding partition walls 6*a*.

The nozzle plate 2 is formed of a metal plate of nickel (Ni) and manufactured by electroforming. The nozzles 4 each of 10 to 35 μm in diameter are formed in the nozzle plate 2 in correspondence to the pressure liquid chambers 6. The nozzle plate 2 is bonded to the channel plate 1 with an adhesive agent. As described below, a resin layer 32 (whose graphical representation is omitted in FIGS. 3 and 4) to serve as a water-repellent layer is formed at the surface of the nozzle plate 2 on the liquid droplet discharge side (the surface of the nozzle plate 2 in the discharge direction; the discharge surface of the nozzle plate 2; or the surface of the nozzle plate 2 on the side opposite to the pressure liquid chambers 6).

The diaphragm 3 is formed of a metal plate of nickel (Ni) and manufactured by electroforming. The part of the diaphragm 3 corresponding to the liquid pressure chambers 6 is formed as a thin-wall part so as to facilitate deformation. A connecting part (not graphically illustrated) for joining to the piezoelectric elements 12 is provided in the center part of the diaphragm 3.

The piezoelectric elements 12 are formed by joining a stacked piezoelectric element member to the base member 13 and thereafter dividing the stacked piezoelectric element member by performing groove processing thereon with a dicing saw. The support parts 12A in the above-described bi-pitch structure of FIG. 3 are piezoelectric element members formed by groove processing, but merely serve as supports because no drive voltage is applied thereto.

According to the liquid discharge head thus configured, for example, in the case of driving the liquid discharge head by a push ejection method, drive pulse voltages of 20 to 50 V are applied from a control part (not graphically illustrated) to selected ones of the piezoelectric elements 12 in accordance with an image to be recorded, so that the piezoelectric elements 12 to which the pulse voltages have been applied are displaced to deform the diaphragm 3 toward the nozzle plate 2, thereby pressurizing liquid in the corresponding pressure liquid chambers 6 through changes in their volumes so as to cause liquid droplets to be discharged from the corresponding nozzles 4 of the nozzle plate 2. As liquid droplets are discharged, the pressures in the pressure liquid chambers 6 are reduced, so that slight negative pressures are generated in the pressure liquid chambers 6 because of the inertia of liquid flow at this point. Stopping the voltage application to the selected piezoelectric elements 12 under this condition causes the diaphragm 3 to return to its original position, so that the corresponding pressure liquid chambers 6 return to their original shape, thus generating further negative pressures. At this point, the pressure liquid chambers 6 are filled with recording liquid from the common liquid chambers 10, and liquid droplets are discharged from the nozzles 4 in accordance with the next drive pulse application.

In addition to the above-described push ejection method, the liquid discharge head may also be driven by other methods such as a pull ejection method (applying pressure through the restoring force of the diaphragm 3 by releasing the diaphragm 3 in a pulled state) and a pull-push ejection method (first retaining the diaphragm 3 in the middle position, then pulling the diaphragm 3 from this position, and thereafter pushing up the diaphragm 3).

Figure 5:
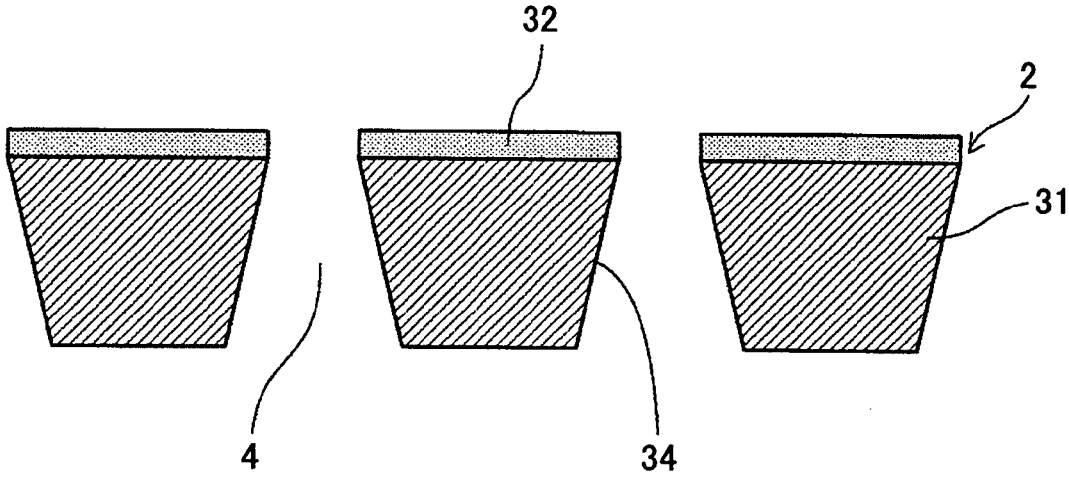
FIG. 5 is an enlarged cross-sectional view of part of a nozzle plate of the liquid discharge head according to the first embodiment of the present invention.

A description is given, with reference also to FIG. 5, of the nozzle plate 2 serving as a nozzle formation member in this liquid discharge head.

This nozzle plate 2 is formed by applying and forming the silicone resin layer 32 serving as a water-repellent layer on the discharge-surface-side surface of a nozzle base material 31 formed of a Ni metal plate in which nozzle holes 34 to serve as the nozzles 4 are formed.

Here, the nozzle base material 31 may be, but is not limited to, a Ni metal plate. A resin material such as polyimide with nozzle holes formed therein by an excimer laser or a lamination member of a metal material and a resin material may also be used. As a result of using a metal material for the nozzle base material 31, a highly rigid nozzle plate is obtained. Further, using a resin material for the nozzle base material 31 provides good adhesion to the silicone resin layer 32 forming a water-repellent layer, thus improving durability.

The thickness of the silicone resin layer 32 is less than or equal to 10 μm, preferably greater than or equal to 0.1 μm and less than 1 μm, considering resistance to wiping and effects on water repellency and droplet discharging. Further, good water repellency can be realized with the surface roughness Ra of the silicone resin layer 32 being 0.2 or less.

Further, as a result of forming the silicone resin layer 32 by application, the silicone resin layer 32 is formed to be gradually increased in thickness into a rounded shape around each nozzle 4. By the resin layer 32 having such a rounded shape around each of the openings corresponding to the nozzles 4, it is possible to prevent a wiping blade from catching the resin film 32 to peel it off when wiping is performed.

Application of resin to form this silicone resin layer 32 is preferably performed in the atmosphere with a dispenser. Performing application in the atmosphere makes it possible to apply resin with ease with inexpensive facilities, and employment of a dispenser makes it possible to easily apply a necessary amount of resin to an area that requires application. As a result, it is possible to reduce cost.

A resin film of dimethyl silicone is particularly preferable as the silicone resin layer 32 if a liquid to be discharged contains fluorochemical. Further, a cold setting coating material is preferable in order to easily form the silicone resin layer 32 at low cost. The coating material may also be an ultraviolet curing type. For example, SR2410 (product name) manufactured by Dow Corning Toray Silicone Co., Ltd. or KR400 (product name) manufactured by Shin-Etsu Chemical Co., Ltd. may be used. Using a cold setting liquid silicone resin enables application in the atmosphere. In particular, it is preferable to use a liquid silicone resin accompanied by hydrolysis.

This silicone resin layer 32 is formed so that the number of water-repellent molecular chains is greater than or equal to half of the number of hydrophilic molecular chains on the surface (facing away from the nozzle base material 31) of the silicone resin layer 32 and that the number of hydrophilic molecular chains is greater on the other side (on the side of the interface with the nozzle base material 31) of the silicone resin layer 32 than on the surface. Examples of water-repellent molecular chains include those having a water-repellent group, of which examples include a fluorinated hydrocarbon group, a polydimethylsiloxane group, an aliphatic hydrocarbon group, an aromatic hydrocarbon group with an aliphatic side chain, and an aromatic hydrocarbon group.

Figure 6:
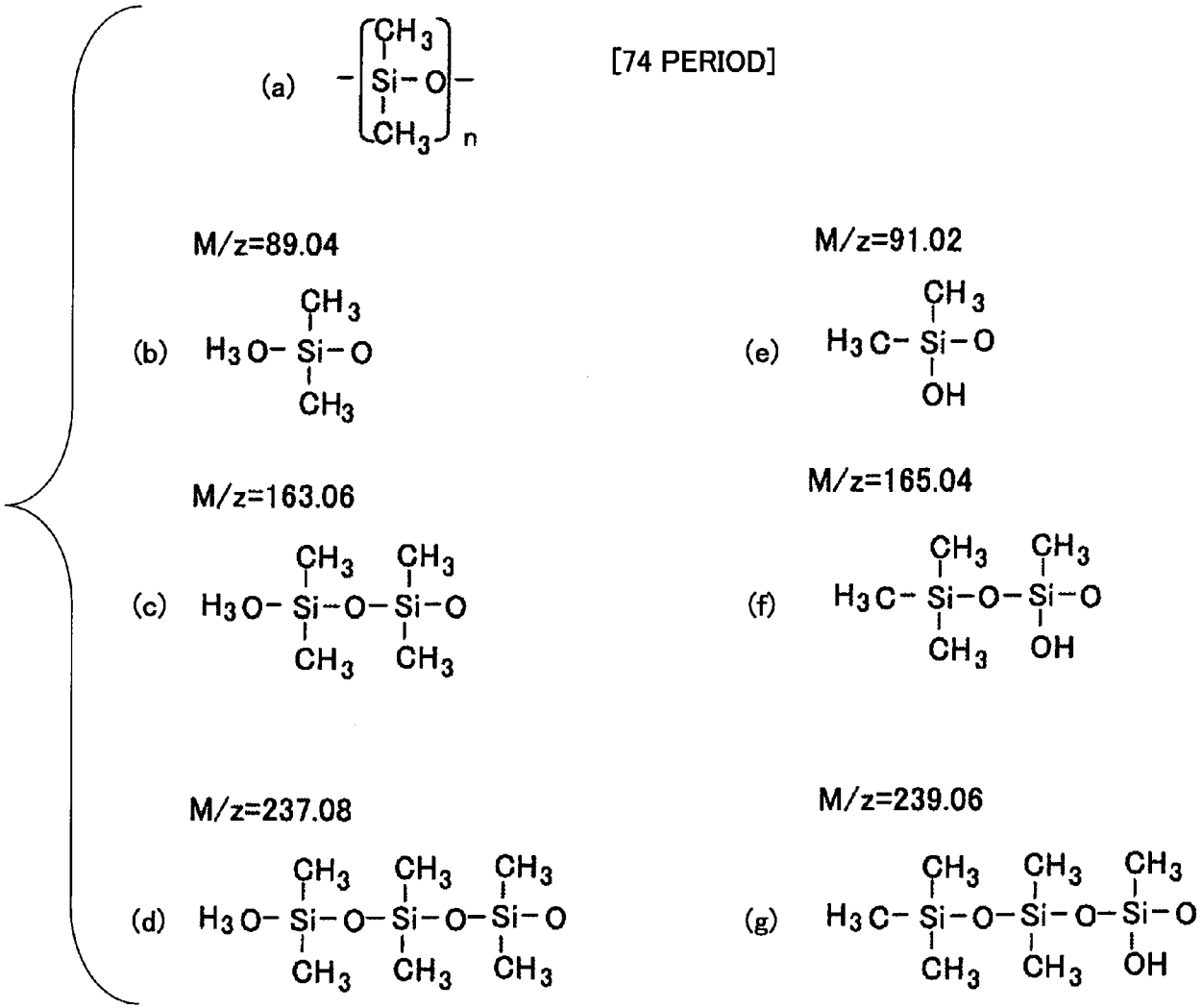
FIG. 6 is a diagram for illustrating a structure of a 74 period molecular chain forming a silicone resin layer according to the first embodiment of the present invention.
Figure 7:
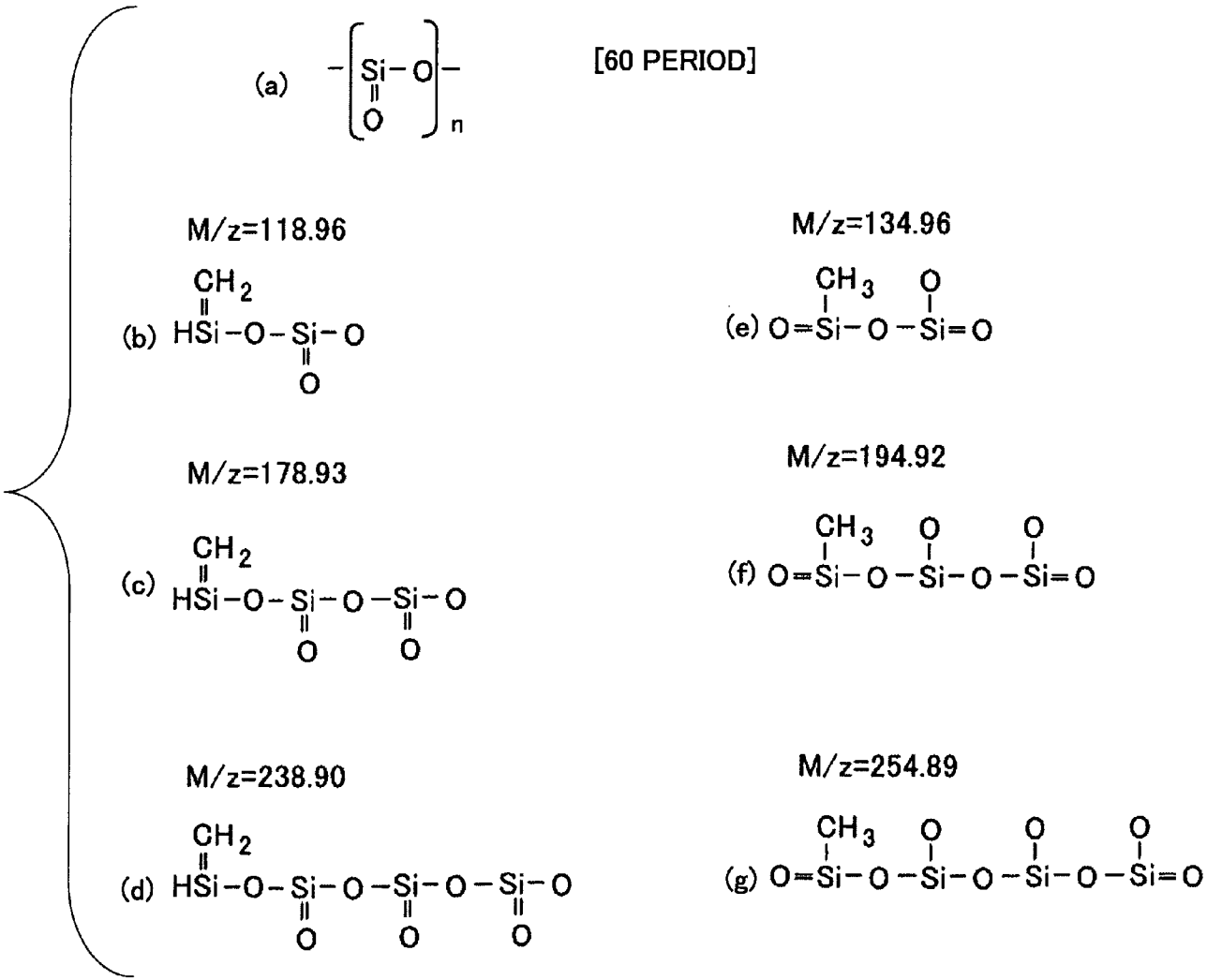
FIG. 7 is a diagram for illustrating a structure of a 60 period molecular chain forming a silicone resin layer according to the first embodiment of the present invention.

For example, in the case of using a dimethyl silicone-based resin as the silicone resin layer 32, water-repellent dimethyl silicone (a molecular component of a mass number period of 74 or a molecular component formed of one or more units each having a formula weight of 74) may have structures expressed as shown in (b) through (g) of FIG. 6 with the structure of (a) of FIG. 6 serving as a basic unit (structure), and hydrophilic $SiO_2$ (a molecular component having a mass number period of 60 or a molecular component formed of one or more units each having a formula weight of 60) may have structures expressed as shown in (b) through (g) of FIG. 7 with the structure of (a) of FIG. 7 serving as a basic unit (structure). Here, the molecular components of a mass number period of 74 of (b) through (g) of FIG. 6 are expressed by 89.04, 163.06, 237.08, 91.02, 165.04, and 239.06, respectively, and the molecular components of a mass number period of 60 of (b) through (g) of FIG. 7 are expressed by 118.96, 178.93, 238.90, 134.96, 194.92, and 254.89, respectively.

Therefore, the silicone resin layer 32 is formed so that the number of molecular chains of molecular components of a mass number period of 74 "$(SiC_2H_6O)n$" (hereinafter referred to as "the number of 74 period molecular chains") is greater than or equal to half of the number of molecular chains of molecular components of a mass number period of 60 "(SiO)n" (hereinafter referred to as "the number of 60 period molecular chains") on the surface of the silicone resin layer 32. That is, the silicone resin layer 32 is formed so that the relationship "the number of 74 period molecular chains/the number of 60 period molecular chains>0.5" holds.

At this point, the number of 60 period molecular chains is greater on the side of the interface with the nozzle base material 31 in the silicone resin layer 32 than on the surface thereof. In this case, by forming the silicone resin layer 32 having the above-described relationship between the number of 74 period molecular chains and the number of 60 period molecular chains at the surface of the nozzle plate 2, the number of 60 period molecular chains is greater on the side of the interface with the nozzle base material 31 (on the side of the surface of the nozzle base material 31) in the silicone resin layer 32 than on the surface thereof.

According to experiments conducted by the inventor of the present invention, it has been confirmed that recording liquid containing a fluorochemical surfactant (fluorochemical) is well repelled when the above-described relationship holds. It has been confirmed that when the number of 74 period molecular chains/the number of 60 period molecular chains<0.5, sufficient water repellency is produced to cause no ejection curving with respect to recording liquid free of fluorochemical (a fluorine-containing compound) while water repellency is insufficiently produced (or not produced) to cause ejection curving with respect to recording liquid containing fluorochemical (a fluorine-containing compound). The results of this experiment are shown below in Table 1.

TABLE 1

| 74 PERIOD/ | FLUOROCHEMICAL-CONTAINING INK | | FLUOROCHEMICAL-FREE INK | |
|---|---|---|---|---|
| 60 PERIOD | INK REPELLENCY | EJECTION CURVING | INK REPELLENCY | EJECTION CURVING |
| 0.3 | X | X | ○ | ○ |
| 0.4 | Δ | X | ○ | ○ |
| 0.5 | ○ | ○ | ○ | ○ |
| 0.6 | ○ | ○ | ○ | ○ |
| 0.7 | ○ | ○ | ○ | ○ |

○: GOOD,
Δ: RATHER POOR,
X: POOR

Table 1 shows the results of a surface analysis of a silicone resin according to a TOF-SIMS (Time-of-Flight Secondary Ion Mass Spectroscopy) analysis under the following conditions:

Measuring Apparatus: TOF-SIMS300 (manufactured by ION-TOF),

Primary Ion Source: Au,

Measured Ion Type: + and −,

Measurement Area: 500 μm square, and

Measurement Depth: approximately first molecular layer.

Further, a description is given below of specific examples of recording liquid used.

By thus using recording liquid containing fluorochemical, the dynamic surface tension can be less than or equal to 30 mN/m. By using recording liquid having a low dynamic surface tension of 30 mN/m or less, the rate of ink penetration into paper becomes higher, and in particular, a drying time in the case of using a pigment-based ink can be shortened. Further, by adding a fluorochemical surfactant, it is possible to form an image with good color development.

By thus forming a silicone resin layer on the liquid discharge surface side so that the number of water-repellent molecular chains is greater than or equal to half of the number of hydrophilic molecular chains on the surface of the silicon resin layer and that the number of hydrophilic molecular chains is greater on the side of the interface with a base material in the silicone resin layer than on the surface thereof, good water repellency is produced at the time of discharging liquid, in particular, liquid containing fluorochemical (a fluorine-containing compound).

In particular, since the silicone resin layer is formed so that the number of molecular chains having molecular components of a mass number (formula weight) period of 74 is greater than or equal to half of the number of molecular chains having molecular components of a mass number (formula weight) period of 60 on the surface of the silicone resin layer and that the number of molecular chains having molecular components of a mass number (formula weight period) of 60 is greater on the side of the interface with the base material in the silicone resin layer than on the surface thereof, good water repellency can be produced at the time of discharging liquid, in particular, liquid containing fluorochemical as described below.

Next, a description is given of recording liquid (ink) as liquid discharged from this liquid discharge head.

The ink discharged from a liquid discharged head according to the present invention contains at least water, a coloring agent, and a wetting agent, and further contains a penetrant, a surfactant, and as required, other components.

Here, more preferably, the ink has a surface tension of 15 to 30 mN/m at 25° C. If the surface tension is less than 15 mN/m, the ink may excessively wet the nozzle plate of the liquid discharge head according to the present invention and prevent proper ink droplet formation (particle generation), so as to prevent stable ink discharging. Further, if the surface tension exceeds 30 mN/m, the ink may not sufficiently penetrate a recording medium, so as to cause beading or a longer drying time.

The surface tension may be measured, for example, with a platinum plate at 25° C. using a surface tensiometer (CBVP-Z, manufactured by Kyowa Interface Science Co., Ltd.).

[Coloring Agent]

As a coloring agent contained in ink, it is preferable to use at least one of pigment, dye, and colored fine particles.

Examples of suitably used colored fine particles include a water dispersion of polymer fine particles containing at least one of coloring materials of pigment and dye.

Here, the phrase "containing coloring material" means one or both of the condition where coloring material is enclosed in polymer fine particles and the condition where coloring material is adsorbed to the surfaces of polymer fine particles. In this case, a coloring material mixed into the ink according to the present invention does not have to be entirely enclosed in or adsorbed to polymer fine particles, and may be dispersed in an emulsion as long as one or more effects of the present invention are not impaired. The coloring material is not limited in particular as long as it is insoluble or difficult to dissolve in water and absorbable to the polymer, and may be suitably selected in accordance with a purpose.

The phrase "insoluble or difficult to dissolve in water" means that a coloring material is not dissolved as much as ten parts by weight or more in 100 parts by weight of water at 20° C. Further, the term "dissolved" means that separation or sedimentation of a coloring material cannot be visually recognized at the top or bottom layer of an aqueous solution.

Further, the polymer fine particles containing coloring material (colored fine particles) are preferably 0.01 to 0.16 μm in volume average particle size in ink.

Examples of the coloring agent include dyes such as a water-soluble dye, an oil-soluble dye, and a disperse dye, and pigments. Oil-soluble and disperse dyes are preferable in terms of good absorbability and enclosability, while pigments are preferred in terms of the light fastness of an image produced.

In terms of efficient impregnation into polymer fine particles, the above-described dyes are preferably dissolved as much as 2 g/litter or more, and more preferably 20 to 600 g/litter, in an organic solvent such as a ketone-based solvent.

Examples of water-soluble dyes include those classified as acid dyes, direct dyes, basic dyes, reactive dyes, and food colors in Color Index, and those excellent in water resistance and light fastness are preferably used.

In this case, examples of acid dyes and food colors include C.I. acid yellow 17, 23, 42, 44, 79 and 142; C.I. acid red 1, 8, 13, 14, 18, 26, 27, 35, 37, 42, 52, 82, 87, 89, 92, 97, 106, 111, 114, 115, 134, 186, 249, 254 and 289; C.I. acid blue 9, 29, 45, 92 and 249; C.I. acid black 1, 2, 7, 24, 26, and 94; C.I. food yellow 3 and 4; C.I. food red 7, 9, and 14; and C.I. food black 1 and 2.

Further, examples of direct dyes include C.I. direct yellow 1, 12, 24, 26, 33, 44, 50, 86, 120, 132, 142 and 144; C.I. direct red 1, 4, 9, 13, 17, 20, 28, 31, 39, 80, 81, 83, 89, 225 and 227; C.I. direct orange 26, 29, 62 and 102; C.I. direct blue 1, 2, 6, 15, 22, 25, 71, 76, 79, 86, 87, 90, 98, 163, 165, 199 and 202; and C.I. direct black 19, 22, 32, 38, 51, 56, 71, 74, 75, 77, 154, 168 and 171.

Further, examples of basic dyes include C.I. basic yellow 1, 2, 11, 13, 14, 15, 19, 21, 23, 24, 25, 28, 29, 32, 36, 40, 41, 45, 49, 51, 53, 63, 64, 65, 67, 70, 73, 77, 87, and 91; C.I. basic red 2, 12, 13, 14, 15, 18, 22, 23, 24, 27, 29, 35, 36, 38, 39, 46, 49, 51, 52, 54, 59, 68, 69, 70, 73, 78, 82, 102, 104, 109, and 112; C.I. basic blue 1, 3, 5, 7, 9, 21, 22, 26, 35, 41, 45, 47, 54, 62, 65, 66, 67, 69, 75, 77, 78, 89, 92, 93, 105, 117, 120, 122, 124, 129, 137, 141, 147, and 155; and C.I. basic black 2 and 8.

Further, examples of reactive dyes include C.I. reactive black 3, 4, 7, 11, 12 and 17; C.I. reactive yellow 1, 5, 11, 13, 14, 20, 21, 22, 25, 40, 47, 51, 55, 65 and 67; C.I. reactive red 1, 14, 17, 25, 26, 32, 37, 44, 46, 55, 60, 66, 74, 79, 96 and 97; and C.I. reactive blue 1, 2, 7, 14, 15, 23, 32, 35, 38, 41, 63, 80 and 95.

There are no particular limitations on pigments, and a pigment suitable for a purpose may be selected. For example, either inorganic or organic pigments may be used.

Examples of inorganic pigments include titanium oxide, ferric oxide, calcium carbonate, barium sulfate, aluminum hydroxide, barium yellow, cadmium red, chrome yellow, and carbon black. Of those, carbon black is preferable. Examples of carbon black include those manufactured by known methods such as the contact, furnace, and thermal processes.

Examples of organic pigments include azo pigments, polycyclic pigments, dye chelates, nitro pigments, nitroso pigments, and aniline black. Of those, azo pigments and polycyclic pigments are more preferable. Examples of azo pigments include azo lakes, insoluble azo pigments, condensation azo pigments, and chelate azo pigments. Examples of polycyclic pigments include phthalocyanine pigments, perylene pigments, perynon pigments, anthraquinone pigments, quinacridone pigments, dioxazine pigments, indigo pigments, thioindigo pigments, isoindolinone pigments, and quinophthalone pigments. Examples of dye chelates include basic dye chelates and acid dye chelates.

There no particular limitations on the colors of pigments, and a color suitable for a purpose may be selected. For example, pigments for black and pigments for other colors may be used. Any of these pigments may be used alone or in combination with one or more of them.

Example of pigments for black include carbon blacks (C.I. pigment black 7) such as furnace black, lampblack, acetylene black, and channel black; metals such as copper, iron (C.I. pigment black 11), and titanium oxide; and organic pigments such as aniline black (C.I. pigment black 1).

Examples of pigments for other colors are as follows.

Examples of pigments for yellow ink include C.I. pigment yellow 1 (fast yellow G), 3, 12 (disazo yellow AAA), 13, 14, 17, 23, 24, 34, 35, 37, 42 (yellow iron oxide), 53, 55, 74, 81, 83 (disazo yellow HR), 95, 97, 98, 100, 101, 104, 108, 109, 110, 117, 120, 138, 150, and 153.

Examples of pigments for magenta include C.I. pigment red 1, 2, 3, 5, 17, 22 (brilliant fast scarlet), 23, 31, 38, 48:1 (permanent red 2B (Ba)), 48:2 (permanent red 2B (Ca)), 48:3 (permanent red 2B (Sr)), 48:4 (permanent red 2B (Mn)), 49:1, 52:2, 53:1, 57:1 (brilliant carmine 6B), 60:1, 63:1, 63:2, 64:1, 81 (rhodamine 6G lake), 83, 88, 92, 101 (colcothar), 104, 105, 106, 108 (cadmium red), 112, 114, 122 (dimethyl quinacridone), 123, 146, 149, 166, 168, 170, 172, 177, 178, 179, 185, 190, 193, 209, and 219.

Examples of pigments for cyan include C.I. pigment blue 1, 2, 15 (phthalocyanine blue R), 15:1, 15:2, 15:3 (phthalocyanine blue G), 15:4, 15:6 (phthalocyanine blue E), 16, 17:1, 56, 60, and 63.

Examples of pigments for neutral tints include, for red, green, and blue, C.I. pigment red 177, 194, and 224; C.I. pigment orange 43; C.I. pigment violet 3, 19, 23, and 37; and C.I. pigment green 7 and 36.

Examples of suitably used pigments include a self-dispersing pigment having at least one type of hydrophilic group bonded directly or through another atomic group to the surface of the pigment so as to be stably dispersible without use of a dispersing agent. As a result, unlike in the conventional ink, a dispersing agent for dispersing pigment is no longer required. Ionic self-dispersing pigments are preferable, and those anionically charged or those cationically charged are suitable.

Self-dispersing pigments are preferably 0.01 to 0.16 μm in volume average particle size in ink.

Examples of anionic hydrophilic groups include —COOM, —$SO_3M$, —$PO_3HM$, —$PO_3M_2$, —$SO_2NH_2$, and —$SO_2NHCOR$ (where, in the formulas, M represents a hydrogen atom, alkali metal, ammonium, or organic ammonium, and R represents an alkyl group of 1 to 12 carbon atoms, a phenyl group that may have a substituent, or a naphthyl group that may have a substituent). It is preferable to use a color pigment whose surface has, of those, —COOM or —$SO_3M$ bonded thereto.

Regarding "M" in the above-described hydrophilic groups, examples of alkali metal include lithium, sodium, and potassium; and examples of organic ammonium include monomethylammonium, dimethylammonium, trimethylammonium, monoethylammonium, diethylammonium, triethylammonium, monomethanolammonium, dimethanolammonium, and triethanolammonium. Examples of methods of obtaining the above-described anionically charged color pigments include oxidizing a color pigment with sodium hypochlorite as a method of introducing —COONa to the surface of a color pigment, sulfonating a color pigment, and reacting a diazonium salt with a color pigment.

For example, quaternary ammonium groups are preferable as cationic hydrophilic groups, and the following quaternary ammonium groups are more preferable. Pigments having any of these bonded to their surfaces are suitable as coloring material.

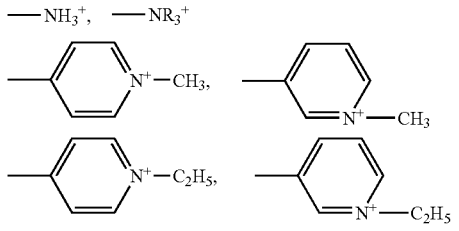

-continued

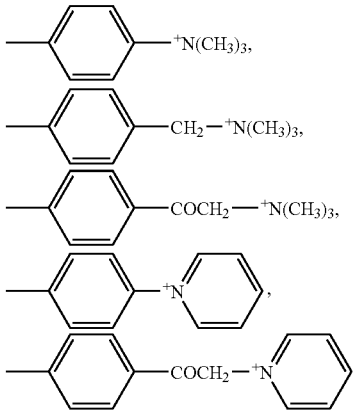

The method of manufacturing cationic self-dispersing carbon black having any of the above-described hydrophilic groups bonded thereto is not limited in particular, and may be suitably selected in accordance with a purpose. For instance, examples of the method of bonding N-ethylpyridyl expressed by the following structural formula include treating carbon black with 3-amino-N-ethylpyridium bromide.

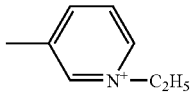

Here, the hydrophilic group may be bonded to the surface of the carbon black through another atomic group. Examples of other atomic groups include an alkyl group of 1 to 12 carbon atoms, a phenyl group that may have a substituent, or a naphthyl group that may have a substituent. Specific examples of bonding of the above-described hydrophilic groups to the surface of carbon black through another atomic group include —$C_2H_4COCM$ (where M represents alkali metal or quaternary ammonium), —$PhSO_3M$ (where Ph represents a phenyl group and M represents alkali metal or quaternary ammonium), and —$C_5H_{10}NH_3$.

Pigment dispersion liquid using a pigment dispersant may also be employed as ink used in a recording method according to the present invention.

Regarding pigment dispersants, examples of natural hydrophilic polymers include vegetable polymers such as gum Arabic, tragacanth gum, gum guaiac, karaya gum, locust bean gum, arabinogalactan, pectin, quince seed starch, and shellac; seaweed polymers such as an alginic acid, carrageenan, and agar; animal polymers such as gelatin, casein, albumin, and collagen; and microbe polymers such as xanthan gum and dextran. Examples of semisynthetic hydrophilic polymers include cellulose polymers such as methyl cellulose, ethyl cellulose, hydroxyethylcellulose, hydroxypropylcellulose, and carboxymethylcellulose; starch polymers such as sodium carboxymethyl starch and sodium starch phosphate; and seaweed polymers such as sodium alginate and propylene glycol alginate. Examples of synthetic hydrophilic polymers include vinyl polymers such as polyvinyl alcohol, polyvinyl pyrrolidone, and polyvinyl methyl ether; acrylic resins such as non-cross-linked polyacrylamide, a polyacrylic acid or its alkali metal salt, and water-soluble styrene acrylic resin; styrene maleic acid resin; water-soluble vinylnaphthalene acrylic resin; water-soluble vinylnaphthalene maleic acid resin; polyvinyl pyrrolidone; polyvinyl alcohol; an alkali metal salt of a condensate of a β-naphthalenesulfonic acid and formalin; and polymers having a salt of a cationic functional group such as quaternary ammonium or an amino group as a side chain. Of these, polymers having a carboxyl group introduced therein, such as those formed of a homopolymer of an acrylic acid, a methacrylic acid, or a styrene acrylic acid or a copolymer of monomers having another hydrophilic acid, are particularly preferable as polymer dispersants.

Here, copolymers are preferably 3,000 to 50,000, and more preferably 7,000 to 15,000, in weight average molecular weight.

Further, the pigment/pigment dispersant mixture mass ratio (pigment:pigment dispersant) is preferably 1:0.06 to 1:3, and more preferably 1:0.125 to 1:3.

The load of the coloring agent in ink is preferably 6 to 15 wt %, and more preferably 8 to 12 wt %. If the load is less than 6 wt %, image density may be lowered because of a decrease in coloring power, or feathering or bleeding may worsen because of a decrease in viscosity. On the other hand, if the load exceeds 15 wt %, nozzles are likely to dry if the inkjet recording apparatus is left unused, so that discharge failure may occur. Further, a decrease in penetrability due to excessively high viscosity or a decrease in image density due to poor dot spreading may result in a coarse image.

[Wetting Agent]

There are no particular limitations on wetting agents, and a wetting agent suitable for a purpose may be selected. For example, at least one selected from polyol compounds, lactam compounds, urea compounds, and saccharides is suitable.

Here, examples of polyol compounds include polyhydric alcohols, polyalcoholic alkyl ethers, polyalcoholic aryl ethers, nitrogen-containing heterocyclic compounds, amides, amines, sulfur-containing compounds, propylenecarbonate, and ethylene carbonate. Any of these compounds may be used alone or in combination with one or more of them.

Examples of polyhydric alcohols include ethylene glycol, diethylene glycol, triethylene glycol, tetraethylene glycol, polyethylene glycol, propylene glycol, dipropylene glycol, tripropylene glycol, polypropylene glycol, 1,3-propanediol, 1,3-butanediol, 1,4-butanediol, 2,3-butanediol, 3-methyl-1,3-butanediol, 1,5-pentanediol, 1,6-hexanediol, glycerol, 1,2,6-hexanetriol, 1,2,4-butanetriol, 1,2,3-butanetriol, and petriol.

Examples of polyalcoholic alkyl ethers include ethyleneglycol monoethyl ether, ethyleneglycol monobutyl ether, diethyleneglycol monomethyl ether, diethyleneglycol monoethyl ether, diethyleneglycol monobutyl ether, tetraethylene glycol monomethyl ether, and propyleneglycol monoethyl ether.

Examples of polyalcoholic aryl ethers include ethyleneglycol monophenyl ether and ethyleneglycol monobenzyl ether.

Examples of nitrogen-containing heterocyclic compounds include N-methyl-2-pyrrolidone, N-hydroxyethyl-2-pyrrolidone, 2-pyrrolidone, 1,3-dimethylimidazolidinone, and ε-caprolactam.

Examples of amides include formamide, N-methyl formamide, and N,N-dimethyl formamide.

Examples of amines include monoethanol amine, diethanol amine, triethanol amine, monoethyl amine, diethyl amine, and triethyl amine.

Examples of sulfur-containing compounds include dimethyl sulfoxide, sulforane, and thiodiethanol.

Of those described above, glycerol, ethylene glycol, diethylene glycol, triethylene glycol, propylene glycol, dipropylene glycol, tripropylene glycol, 1,3-butanediol, 2,3-butanediol, 1,4-butanediol, 3-methyl-1,3-butanediol, 1,3-propanediol, 1,5-pentanediol, tetraethylene glycol, 1,6-hexanediol, 2-methyl-2,4-pentanediol, polyethylene glycol, 1,2,4-butanetriol, 1,2,6-hexanetriol, thiodiglycol, 2-pyrrolidone, N-methyl-2-pyrrolidone, and N-hydroxyethyl-2-pyrrolidone are preferable because excellent effects are produced regarding solubility and prevention of ejection characteristic deficiency due to moisture evaporation.

Examples of lactam compounds include 2-pyrrolidone, N-methyl-2-pyrrolidone, N-hydroxyethyl-2-pyrrolidone, and ε-caprolactam.

Examples of urea compounds include at least one selected from urea, thiourea, ethylene urea, and 1,3-dimethyl-2-imidazolidinone. In general, the load of a urea compound in ink is preferably 0.5 to 50 wt %, and more preferably 1 to 20 wt %.

Examples of saccharides include monosaccharides, disaccharides, oligosaccharides (including trisaccharides and tetrasaccharides), polysaccharides, and derivatives thereof. Of those, glucose, mannose, fructose, ribose, xylose, arabinose, galactose, maltose, cellobiose, lactose, sucrose, trehalose, and maltotriose are preferable, and maltitose, sorbitose, gluconolactone, and maltose are particularly preferable.

Here, the above-described polysaccharides mean broad-sense saccharides, which may include substances existing widely in nature, such as α-cyclodextrin and cellulose.

Derivatives of saccharides include reducing sugars of saccharides (for example, sugar alcohol, which is expressed by the general formula $HOCH_2(CHOH)_nCH_2OH$, where n is an integer of 2 to 5), oxidized sugars (for example, aldonic acids and uronic acids), amino acids, and thio acids. Of these, sugar alcohol is preferable in particular. Examples of sugar alcohol include maltitol and sorbitol.

The content of a wetting agent in ink is preferably 10 to 50 wt %, and more preferably 20 to 35 wt %. If the content is too low, nozzles are likely to dry so that discharge failure of liquid droplets may occur. If the content is too high, the ink viscosity may increase to exceed an appropriate viscosity range.

[Penetrant]

Water-soluble organic solvents such as polyol compounds and glycol ether compounds may be used as penetrants. In particular, at least one of a polyol compound and a glycol ether compound having a carbon number greater than or equal to eight is suitably used.

Here, if the carbon number of the polyol compound is less than eight, sufficient penetrability cannot be obtained. As a result, a recording medium may be contaminated at the time of duplex printing, or ink does not spread sufficiently on the recording medium so that pixels are poorly filled. This may cause a decrease in character quality or image density.

Examples of suitable polyol compounds having a carbon number greater than or equal to eight include 2-ethyl-1,3-hexanediol (solubility: 4.2% [25° C.]) and 2,2,4-trimethyl-1,3-pentanediol (solubility: 2.0% [25° C.]).

There are no particular limitations on glycol ether compounds, and a glycol ether compound suitable for a purpose may be selected. Examples of glycol ether compounds include polyalcoholic alkyl ethers such as ethyleneglycol monoethyl ether, ethyleneglycol monobutyl ether, diethyleneglycol monomethyl ether, diethyleneglycol monoethyl ether, diethyleneglycol monobutyl ether, tetraethylene glycol monomethyl ether, and propyleneglycol monoethyl ether; and polyalcoholic aryl ethers such as ethyleneglycol monophenyl ether and ethyleneglycol monobenzyl ether.

The load of a penetrant is not limited in particular, and a load suitable for a purpose may be selected. The load of a penetrant is preferably 0.1 to 20 wt %, and more preferably 0.5 to 10 wt %.

[Surfactant]

There are no particular limitations on surfactants, and a surfactant suitable for a purpose may be selected. Examples of surfactants include anionic surfactants, nonionic surfactants, ampholytic surfactants, and fluorochemical surfactants.

Examples of anionic surfactants include polyoxyethylenealkyletheracetates, dodecylbenzenesulfonates, laurylates, and polyoxyethylenealkylethersulfates.

Examples of nonionic surfactants include acetylene glycolic surfactants, polyoxyethylenealkylether, polyoxyethylenealkylphenylether, polyoxyethylenealkylester, and polyoxyethylenesorvitane fatty acid ester.

Examples of acetylene glycolic surfactants include 2,4,7,9-tetramethyl-5-decyne-4,7-diol, 3,6-dimethyl-4-octyne-3,6-diol, and 3,5-dimethyl-1-hexyne-3-ol. Commercially-available acetylene glycolic surfactant products include Surfynol 104, 82, 465, 485, and TG of Air Products and Chemicals, Inc. (U.S.).

Examples of ampholytic surfactants include laurylaminopropionates, lauryldimethylbetaine, stearyldimethylbetaine, and lauryldihydroxyethylbetaine. Specifically, examples of ampholytic surfactants include lauryldimethylamine oxide, myristyldimethylamine oxide, stearyldimethylamine oxide, dihydroxyethyllaurylamine oxide, polyoxyethylene (palm oil)alkyldimethylamine oxide, dimethylalkyl (palm) betaine, and dimethyllaurylbetaine.

Of these surfactants, inter alia, those expressed by the following general formulas (I), (II), (III), (IV), (V), and (VI) are suitable.

$$R1\text{-}O\text{—}(CH_2CH_2O)hCH_2COOM \quad (I)$$

In the general formula (I), R1 represents an alkyl group, which has a carbon number of 6 to 14 and may be branched, h represents an integer of 3 to 12, and M represents one selected from an alkali metal ion, quaternary ammonium, quaternary phosphonium, and alkanolamine.

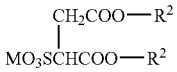

(II)

In the general formula (II), R2 represents an alkyl group, which has a carbon number of 5 to 16 and may be branched, and M represents one selected from an alkali metal ion, quaternary ammonium, quaternary phosphonium, and alkanolamine.

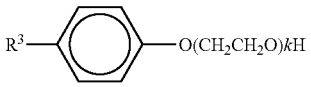

(III)

In the general formula (III), R3 represents a hydrocarbon group such as an alkyl group that has a carbon number of 6 to 14 and may be branched, and k represents an integer of 5 to 20.

$$R4\text{-}(OCH_2CH_2)jOH \quad (IV)$$

In the general formula (IV), R4 represents a hydrocarbon group such as an alkyl group that has a carbon number of 6 to 14, and j represents an integer of 5 to 20.

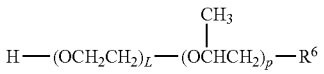

(V)

In the general formula (V), $R^6$ represents a hydrocarbon group such as an alkyl group that has a carbon number of 6 to 14 and may be branched, and each of L and p represents an integer of 1 to 20.

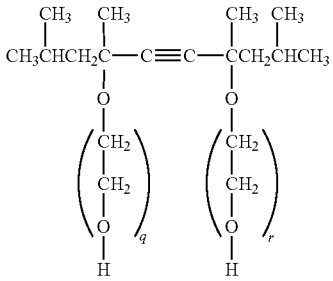

(VI)

In the general formula (VI), each of q and r represents an integer of 0 to 40.

Surfactants of the above-described structural formulas (I) and (II) are specifically shown below in free acid form. First, examples of surfactants of (I) include those expressed by the following (I-1) through (I-6).

$$CH_3(CH_2)_{12}O(CH_2CH_2O)_3CH_2COOH \quad (I\text{-}1)$$

$$CH_3(CH_2)_{12}O(CH_2CH_2O)_4CH_2COOH \quad (I\text{-}2)$$

$$CH_3(CH_2)_{12}O(CH_2CH_2O)_5CH_2COOH \quad (I\text{-}3)$$

$$CH_3(CH_2)_{12}O(CH_2CH_2O)_6CH_2COOH \quad (I\text{-}4)$$

$$CH_3(CH_2)_{11}\underset{\underset{CH_3}{|}}{C}HO(CH_2CH_2O)_6CH_2COOH \quad (I\text{-}5)$$

$$CH_3(CH_2)_6\underset{\underset{(CH_2)_5CH_3}{|}}{C}HO(CH_2CH_2O)_3CH_2COOH \quad (I\text{-}6)$$

Next, examples of surfactants of (II) include those expressed by the following (II-1) through (II-4).

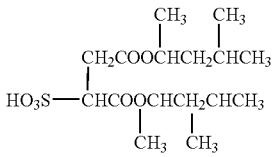

(II-1)

-continued (II-2)

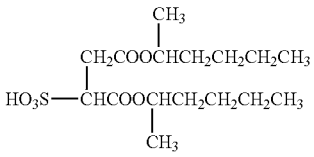

(II-3)

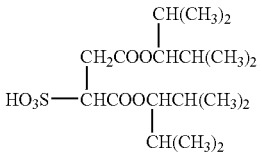

(II-4)

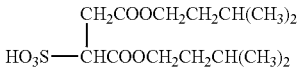

Next, examples of fluorochemical surfactants include those expressed by the following general formula (A).

$$CF_3CF_2(CF_2CF_2)m\text{-}CH_2CH_2O(CH_2CH_2O)nH \quad (A)$$

In the general formula (A), m represents an integer of 0 to 10, and n represents an integer from 1 to 40.

Examples of fluorochemical surfactants include perfluoroalkylsulfonic acid-type compounds, perfluoroalkylcarboxylic acid-type compounds, perfluoroalkylphosphoric acid-type compounds, perfluoroalkyl compounds with an ethylene oxide unit(s), and polyoxyalkylene ether compounds having a perfluoroalkyl ether group as a side chain. Of these, polyoxyalkylene ether compounds having a perfluoroalkyl ether group as a side chain are particularly preferable because they have low foamability and have low fluorine compound bioaccumulation characteristics so as to be highly safe with respect to bioaccumulation of fluorine compounds, which has been seen as a problem of late.

Examples of perfluoroalkylsulfonic acid-type compounds include perfluoroalkylsulfonic acids and perfluoroalkylsulfonates.

Examples of perfluoroalkylcarboxylic acid-type compounds include perfluoroalkylcarboxylic acids and perfluoroalkylcarboxylates.

Examples of perfluoroalkylphosphoric acid-type compounds include perfluoroalkylphosphoric acid ester and perfluoroalkylphosphates.

Further, examples of polyoxyalkylene ether compounds having a perfluoroalkyl ether group as a side chain include polyoxyalkylene ether polymers having a perfluoroalkyl ether group as a side chain, polyoxyalkylene ether sulfate salts having a perfluoroalkyl ether group as a side chain, and salts of polyoxyalkylene ethers having a perfluoroalkyl ether group as a side chain.

Examples of counterions for these salt-type fluorochemical surfactants include ions of Li, Na, K, $NH_4$, $NH_3CH_2CH_2OH$, $NH_2(CH_2CH_2OH)_2$, and $NH(CH_2CH_2OH)_3$.

Further, either suitably synthesized fluorochemical surfactants or commercially available fluorochemical surfactant products may be used.

Examples of commercially available fluorochemical surfactant products include Surflon S-111, S-112, S-113, S-121, S-131, S-132, S-141, and S-145 (manufactured by Asahi Glass Co., Ltd.); Fluorad FC-93, FC-95, FC-98, FC-129, FC-135, FC-170C, FC-430, and FC-431 (manufactured by Sumitomo 3M Ltd.); Megafac F-470, F-1405, and F-474 (manufactured by Dainippon Ink and Chemicals, Inc.); Zonyl TBS, FSP, FSA, FSN-100, FSN, FSO-100, FSO, FS-300, and UR (manufactured by DuPont); FT-110, FT-250, FT-251, FT-400S, FT-150, and FT-400SW (manufactured by Neos co., Ltd.); and PF-151N (manufactured by Omnova Solutions, Inc.). Of these, Zonyl FS-300, FSN, FSN-100, and FSO (manufactured by DuPont) are particularly preferable in terms of excellent reliability and coloring improvement.

[Other Components]

There are no particular limitations on other components, and one or more suitable components may be selected. Examples of other components include a resin emulsion, a pH adjustor, a preservative/fungicide, a rust inhibitor, an antioxidant, an ultraviolet ray absorber, an oxygen absorbent, and a light stabilizer.

The resin emulsion has resin fine particles dispersed in water as a continuous phase, and may contain a dispersing agent such as a surfactant as required.

In general, the content of resin fine particles as a dispersed phase component (the content of resin fine particles in the resin emulsion) is preferably 10 to 70 wt %. Further, the resin fine particles are preferably 10 to 1000 nm, and more preferably 20 to 300 nm, in average particle size particularly in consideration of their use in inkjet recording apparatuses.

There are not particular limitations on the resin fine particle component of the dispersed phase, and a resin fine particle component suitable for a purpose may be selected. Examples of resin fine particle components include acrylic resins, vinyl acetate-based resins, styrene-based resins, butadiene-based resins, styrene-butadiene-based resins, vinyl chloride-based resins, acryl-styrene-based resins, and acryl-silicone-based resins. Of these, acryl-silicone-based resins are particularly preferable.

Either suitably synthesized resin emulsions or commercially available resin emulsion products may be used.

Examples of commercially available resin emulsions include Micro gel E-1002 and E-5002 (styrene-acryl-based resin emulsions, manufactured by Nippon Paint Co., Ltd.), Boncoat 4001 (an acrylic resin emulsion, manufactured by Dai Nippon Ink and Chemicals Inc.), Boncoat 5454 (a styrene-acryl-based resin emulsion, manufactured by Dai Nippon Ink and Chemicals Inc.), SAE-1014 (a styrene-acryl-based resin emulsion, manufactured by Zeon Corp.), Saivinol SK-200 (an acrylic resin emulsion, manufactured by Saiden Chemical Industry Co., Ltd.), Primal AC-22 and AC-61 (an acrylic resin emulsion, manufactured by Rohm and Haas Company), Nanocryl SBCX-2821 and 3689 (acryl-silicone-based resin emulsions, manufactured by Toyo Ink Mfg. Co., Ltd.), and #3070 (a methacrylic acid methyl polymer resin emulsion, manufactured by Mikuni Color Limited).

The load of the resin fine particle component in the resin emulsion in ink is preferably 0.1 to 50 wt %, more preferably 0.5 to 20 wt %, and further preferably 1 to 10 wt %. If the load is less than 0.1 wt %, anti-clogging and discharge stability characteristics may not be sufficiently improved. If the load exceeds 50 wt %, the storage stability of ink may be reduced.

Examples of preservatives/fungicides include 1,2-benzisothiazolin-3-one, sodium dehydroacetate, sodium sorbate, sodium 2-pyridinethiol-1-oxide, sodium benzoic acid, and sodium pentachlorophenol.

There are no particular limitations on pH adjustors as long as pH can be controlled to be greater than or equal to 7 without adversely affecting ink, and a material suitable for a purpose may be selected.

Examples of pH adjustors include amines such as diethanolamine and triethanolamine; alkali metal hydroxides such as lithium hydroxide, sodium hydroxide, and potassium hydroxide; ammonium hydroxide; quaternary ammonium hydroxide; quaternary phosphonium hydroxide; and alkali metal carbonates such as lithium carbonate, sodium carbonate, and potassium carbonate.

Examples of rust inhibitors include acid sulfite, sodium thiosulfate, ammonium thiodiglycolate, diisopropylammonium nitrite, tetra nitric acid pentaerythritol, and dicyclohexylammonium nitrite.

Examples of antioxidants include phenolic antioxidant (including hindered phenolic antioxidants), aminic antioxidants, sulfur-based antioxidants, and phosphoric antioxidants.

Examples of phenolic antioxidant (including hindered phenolic antioxidants) include butylated hydroxyanisole, 2,6-di-tert-butyl-4-ethyl phenol, stearyl-β-(3,5-di-tert-butyl-4-hydroxyphenyl) propionate, 2,2'-methylenebis(4-methyl-6-tert-butylphenol), 2,2'-methylenebis(4-ethyl-6-tert-butylphenol), 4,4'-butylidenebis(3-methyl-6-tert-butylphenol), 3,9-bis[1,1-dimethyl-2-[β-(3-tert-butyl-4-hydroxy-5-methylphenyl) propionyloxy]ethyl]2,4,8,10-tetraoxaspiro[5,5]undecane, 1,1,3-tris(2-methyl-4-hydroxy-5-tert-butylphenyl)butane, 1,3,5-trimethyl-2,4,6-tris(3,5-di-tert-butyl-4-hydroxybenzyl)benzene, and tetrakis[methylene-3-(3',5'-di-tert-butyl-4'-hydroxyphenyl)propionate]methane.

Examples of aminic antioxidants include phenyl-β-naphthylamine, α-naphthylamine, N,N'-di-sec-butyl-p-phenylenediamine, phenothiazine, N,N'-diphenyl-p-phenylenediamine, 2,6-di-tert-butyl-p-cresol, 2,6-di-tert-butylphenol, 2,4-dimethyl-6-tert-butylphenol, butylhydroxyanisole, 2,2'-methylenebis(4-methyl-6-tert-butylphenol), 4,4'-butylidenebis(3-methyl-6-tert-butylphenol), 4,4'-thiobis(3-methyl-6-tert-butylphenol), tetrakis[methylene-3(3,5-di-tert-butyl-4-dihydroxyphenyl)propionate]methane, and 1,1,3-tris(2-methyl-4-hydroxy-5-tert-butylphenyl)butane.

Examples of sulfur-based antioxidants include dilauryl 3,3'-thiodipropionate, distearyl thiodipropionate, lauryl-stearyl thiodipropionate, dimyristyl 3,3'-thiodipropionate, distearyl β,β'-thiodipropionate, 2-mercaptobenzoimidazole, and dilauryl sulfide.

Examples of phosphoric antioxidants include triphenyl phosphite, octadecyl phosphite, triisodecyl phosphite, trilauryl trithiophosphite, and trinonylphenyl phosphite.

Examples of ultraviolet ray absorbers include benzophenone-based ultraviolet ray absorbers, benzotriazole-based ultraviolet ray absorbers, salicylate-based ultraviolet ray absorbers, cyanoacrylate-based ultraviolet ray absorbers, and nickel complex salt-based ultraviolet ray absorbers.

Examples of benzophenone-based ultraviolet ray absorbers include 2-hydroxy-4-n-octoxybenzophenone, 2-hydroxy-4-n-dodecyloxybenzophenone, 2,4-dihydroxybenzophenone, 2-hydroxy-4-methoxybenzophenone, and 2,2',4,4'-tetrahydroxybenzophenone.

Examples of benzotriazole-based ultraviolet ray absorbers include 2-(2'-hydroxy-5'-tert-octylphenyl)benzotriazole, 2-(2'-hydroxy-5'-methylphenyl)benzotriazole, 2-(2'-hydroxy-4'-octoxyphenyl)benzotriazole, and 2-(2'-hydroxy-3'-tert-butyl-5'-methylphenyl)-5-chlorobenzotriazole.

Examples of salicylate-based ultraviolet ray absorbers include phenyl salicylate, p-tert-butylphenyl salicylate, and p-octylphenyl salicylate.

Examples of cyanoacrylate-based ultraviolet ray absorbers include ethyl-2-cyano-3,3'-diphenyl acrylate, methyl-2-cyano-3-methyl-3-(p-methoxyphenyl)acrylate, and butyl-2-cyano-3-methyl-3-(p-methoxyphenyl)acrylate.

Examples of nickel complex salt-based ultraviolet ray absorbers include nickel-bis(octylphenyl) sulfide, nickel (II) 2,2'-thiobis(4-tert-octylferrate)-n-butylamine, nickel (II) 2,2'-thiobis(4-tert-octylferrate)-2-ethylhexylamine, and nickel (II) 2,2'-thiobis(4-tert-octylferrate)triethanolamine.

Ink in the ink medium set according to the present invention is manufactured by dispersing or dissolving at least water, a coloring agent, and a wetting agent in an aqueous medium, together with a penetrating agent and a surfactant as needed, and further with other components as needed, and stirring and mixing them as needed. The dispersing may be performed using, for example, a sand mill, a homogenizer, a ball mill, a paint shaker, or an ultrasonic disperser. The stirring and mixing can be performed using a normal agitator with impellers, a magnetic stirrer, or a high-speed disperser.

The ink viscosity is preferably greater than or equal to 1 cps and less than or equal to 30 cps, and more preferably 2 to 20 cps, at 25° C. If the ink viscosity exceeds 20 cps, it may be difficult to ensure discharge stability.

The ink pH is preferably 7 to 10, for example.

There are no particular limitations on ink colors, and an ink color suitable for a purpose may be selected. Examples of ink colors include yellow, magenta, cyan, and black. A multicolor image can be formed by performing recording using an ink set employing two or more of these colors. A full-color image can be formed by performing recording using an ink set employing all of these colors.

Next, a description is given of specific example implementations. However, a liquid (recording liquid) discharged from a liquid discharge head according to the present invention is not limited to the following example implementations.

EXAMPLE PREPARATION 1

Preparation of Dispersion of Polymer Fine Particles Containing Copper Phthalocyanine Pigment After sufficient replacement with a nitrogen gas in a 1 L flask having a mechanical agitator, a thermometer, a nitrogen gas introducing tube, a reflux tube, and a droplet funnel, 11.2 g of styrene, 2.8 g of acrylate, 12.0 g of lauryl methacrylate, 4.0 g of polyethylene glycol methacrylate, 4.0 g of styrene macromer (product name: AS-6, manufactured by Toagosei Co., Ltd.), and 0.4 g of mercapto ethanol were introduced into the flask, and the flask was heated to 65° C. Then, an aqueous mixture of 100.8 g of styrene, 25.2 g of acrylate, 108.0 g of lauryl methacrylate, 36.0 g of polyethylene glycol methacrylate, 60.0 g of hydroxyethyl methacrylate, 36.0 g of styrene macromer (product name: AS-6, manufactured by Toagosei Co., Ltd.), 3.6 g of mercapto ethanol, 2.4 g of azobis dimethyl valeronitrile, and 18 g of methyl ethyl ketone was dropped into the flask in 2.5 hours.

After the dropping was completed, an aqueous mixture of 0.8 g of azobis dimethyl valeronitrile and 18 g of methyl ethyl ketone was dropped into the flask in 0.5 hours. After aging the mixture for 1 hour at 65° C., 0.8 g of azobis dimethyl valeronitrile were added, and the mixture was further aged for 1 hour. After completion of the reaction, 364 g of methyl ethyl ketone were added into the flask, thereby obtaining 800 g of a polymer solution of a 50 wt % density. Then, the polymer solution was partly dried, and was measured by gel permeation chromatography (standard: polystyrene, solvent; tetrahydrofuran), according to which the weight average molecular weight (Mw) was 15000.

Next, 28 g of the obtained polymer solution, 26 g of a copper phthalocyanine pigment, 13.6 g of 1 mol/L potassium hydroxide solution, 20 g of methyl ethyl ketone, and 30 g of ion-exchanged water were sufficiently stirred, and thereafter mixed (or kneaded) 20 times using a three-roll mill (product name: NR-84A, manufactured by Noritake Company). The obtained paste was put in 200 g of ion-exchange water. After sufficiently stirring the mixture, methyl ethyl ketone and water were evaporated using an evaporator, thereby obtaining 160 g of a blue polymer fine particle dispersion whose solid content is 20.0 wt %.

The average particle size (D 50%) of the obtained polymer fine particles measured with a particle size distribution measuring apparatus (Microtrac UPA, Manufactured by Nikkiso Co., Ltd.) was 93 nm.

EXAMPLE PREPARATION 2

Preparation of Dispersion of Polymer Fine Particles Containing Dimethyl Quinacridone Pigment A magenta polymer fine particle dispersion was prepared the same as in Example Preparation 1 except that the copper phthalocyanine pigment was changed to C.I. pigment red 122.

The average particle size (D 50%) of the obtained polymer fine particles measured with a particle size distribution measuring apparatus (Microtrac UPA, Manufactured by Nikkiso Co., Ltd.) was 127 nm.

EXAMPLE PREPARATION 3

Preparation of Dispersion of Polymer Fine Particles Containing Monoazo Yellow Pigment A yellow polymer fine particle dispersion was prepared the same as in Example Preparation 1 except that the copper phthalocyanine pigment was changed to C.I. pigment yellow 74.

The average particle size (D 50%) of the obtained polymer fine particles measured with a particle size distribution measuring apparatus (Microtrac UPA, Manufactured by Nikkiso Co., Ltd.) was 76 nm.

EXAMPLE PREPARATION 4

Preparation of Dispersion of Polymer Fine Particles Containing Carbon Black Treated With Sulfonating Agent First, 150 g of a commercially available carbon black pigment (Printex #85, manufactured by Degussa AG) was well mixed into 400 ml of sulfolane. After the mixture was subjected to slight dispersing with a bead mill, 15 g of a sulfamic acid was added to the mixture, and the mixture was stirred for 10 hours at 140 to 150° C. Then, the resultant slurry was put in 1000 ml of ion-exchanged water, and was subjected to centrifugation at 12,000 rpm so that a surface-treated carbon black wet cake was obtained. The obtained carbon black wet cake was redispersed in 2000 ml of ion exchanged water, and its pH was adjusted with lithium hydroxide. Then, the dispersion was subjected to desalination and concentration with an ultrafilter membrane, so that a carbon black dispersion having a pigment concentration of 10% was obtained. This dispersion was filtrated with a 1 μm nylon filter.

The average particle size (D 50%) of the resultant carbon black dispersion measured with a particle size distribution measuring apparatus (Microtrac UPA, Manufactured by Nikkiso Co., Ltd.) was 80 nm.

EXAMPLE MANUFACTURE 1

Preparation of Cyan Ink

First, 20.0 wt % of the copper phthalocyanine pigment-containing polymer fine particle dispersion of Example Preparation 1, 23.0 wt % of 3-methyl-1,3-butanediol, 8.0 wt % of glycerin, 2.0 wt % of 2-ethyl-1,3-hexanediol, 2.5 wt % of FS-300 (manufactured by DuPont) as a fluorochemical surfactant, 0.2 wt % of PROXEL LV (manufactured by Avecia) as a preservative/fungicide, 0.5 wt % of 2-amino-2-ethyl-1,3-propanediol, and an appropriate amount of ion-exchanged water were added up to be 100 wt %, and thereafter the mixture was filtrated with a membrane filter of 8 μm in average pore size. Thereby, a cyan ink was prepared.

EXAMPLE MANUFACTURE 2

Preparation of Magenta Ink

First, 20.0 wt % of the dimethyl quinacridone pigment-containing polymer fine particle dispersion of Example Preparation 2, 22.5 wt % of 3-methyl-1,3-butanediol, 9.0 wt % of glycerin, 2.0 wt % of 2-ethyl-1,3-hexanediol, 2.5 wt % of FS-300 (manufactured by DuPont) as a fluorochemical surfactant, 0.2 wt % of PROXEL LV (manufactured by Avecia) as a preservative/fungicide, 0.5 wt % of 2-amino-2-ethyl-1,3-propanediol, and an appropriate amount of ion-exchanged water were added up to be 100 wt %, and thereafter the mixture was filtrated with a membrane filter of 8 μm in average pore size. Thereby, a magenta ink was prepared.

EXAMPLE MANUFACTURE 3

Preparation of Yellow Ink

First, 20.0 wt % of the monoazo yellow pigment-containing polymer fine particle dispersion of Example Preparation 3, 24.5 wt % of 3-methyl-1,3-butanediol, 8.0 wt % of glycerin, 2.0 wt % of 2-ethyl-1,3-hexanediol, 2.5 wt % of FS-300 (manufactured by DuPont) as a fluorochemical surfactant, 0.2 wt % of PROXEL LV (manufactured by Avecia) as a preservative/fungicide, 0.5 wt % of 2-amino-2-ethyl-1,3-propanediol, and an appropriate amount of ion-exchanged water were added up to be 100 wt %, and thereafter the mixture was filtrated with a membrane filter of 8 μm in average pore size. Thereby, a yellow ink was prepared.

EXAMPLE MANUFACTURE 4

Preparation of Black Ink

First, 20.0 wt % of the carbon black dispersion of Example Preparation 4, 22.5 wt % of 3-methyl-1,3-butanediol, 7.5 wt % of glycerin, 2.0 wt % of 2-pyrrolidone, 2.0 wt % of 2-ethyl-1,3-hexanediol, 2.5 wt % of FS-300 (manufactured by DuPont) as a fluorochemical surfactant, 0.2 wt % of PROXEL LV (manufactured by Avecia) as a preservative/fungicide, 0.5 wt % of 2-amino-2-ethyl-1,3-propanediol, and an appropriate amount of ion-exchanged water were added up to be 100 wt %, and thereafter the mixture was filtrated with a membrane filter of 8 μm in average pore size. Thereby, a black ink was prepared.

Next, the surface tensions and viscosities of the obtained inks of Example Manufactures 1 through 4 were measured as follows. Table 2 shows the measurement results.

[Viscosity Measurement]

The viscosities were measured at 25° C. under the conditions of a cone of 1° 34'×R24, a rotation speed of 60 rpm, and a measurement time of 3 min. using an R-500 viscometer (manufactured by TOKI SANGYO CO., LTD).

[Surface Tension Measurement]

The surface tensions were static ones measured with a platinum plate at 25° C. using a surface tensiometer (CBVP-Z, manufactured by Kyowa Interface Science Co., Ltd.).

TABLE 2

| | Viscosity (mPa · S) | Surface Tension (mN/m) |
|---|---|---|
| Example Manufacture 1 | 8.05 | 25.4 |
| Example Manufacture 2 | 8.09 | 25.4 |
| Example Manufacture 3 | 8.11 | 25.7 |
| Example Manufacture 4 | 8.24 | 25.4 |

When the above-described liquid discharge head according to one embodiment of the present invention was caused to discharge liquid droplets using the inks of Example Manufactures 1 through 4 containing a fluorochemical surfactant, it was possible to satisfactorily discharge liquid droplets without ejection curving.

In the above-described embodiment, the liquid discharge head is described as having a piezoelectric actuator using a piezoelectric element as a pressure generation part. However, the liquid discharge head is not limited to this, and may have, as a pressure generation part that generates pressure for discharging liquid droplets, a thermal actuator that utilizes a phase change due to the film boiling of liquid using an electrothermal transducer such as a heat element, a shape-memory alloy actuator that utilizes a metallic phase change due to a change in temperature, or an electrostatic actuator that uses electrostatic force.

Figure 8:
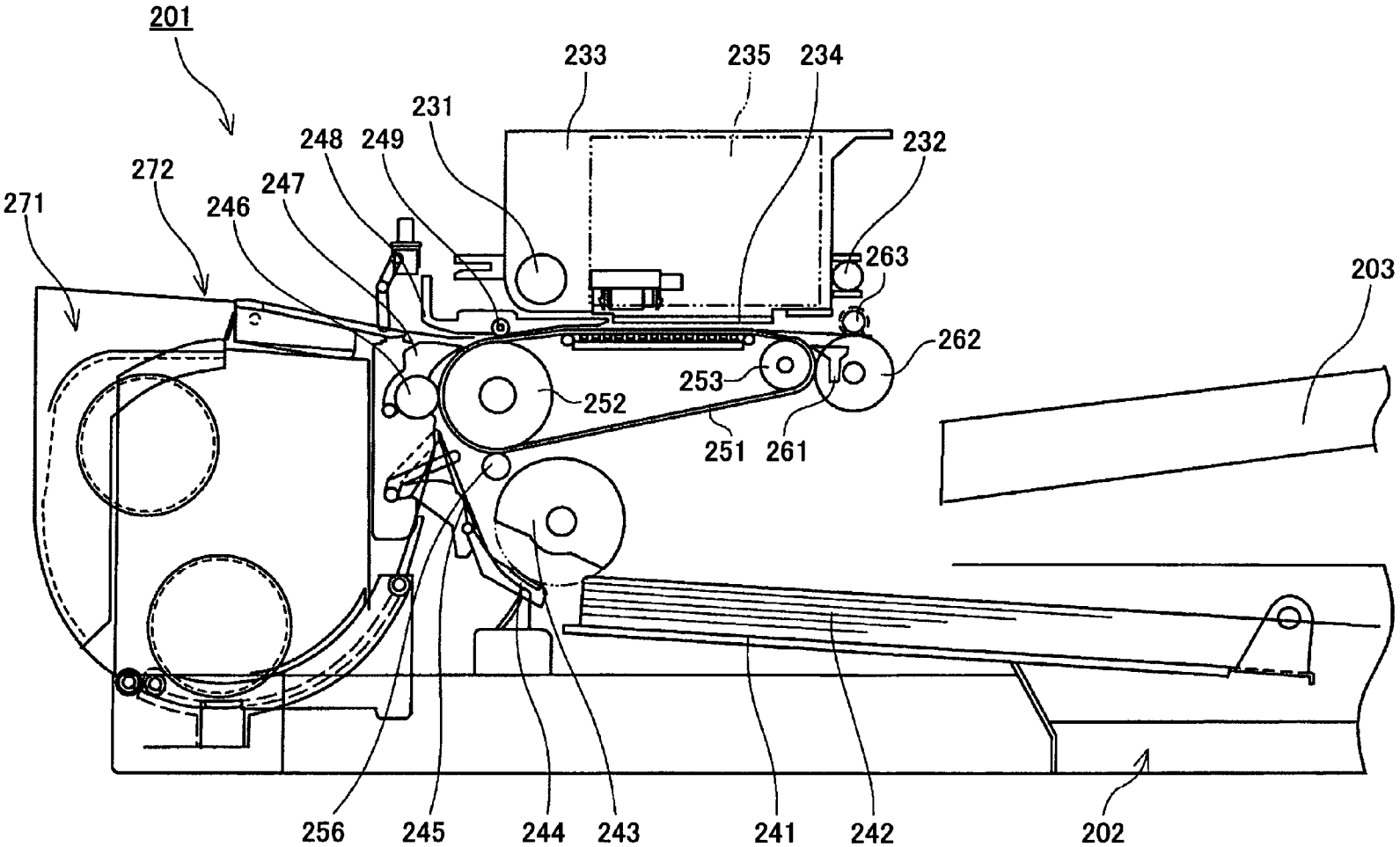
FIG. 8 is a schematic diagram showing an image forming apparatus according to a second embodiment of the present invention.
Figure 9:
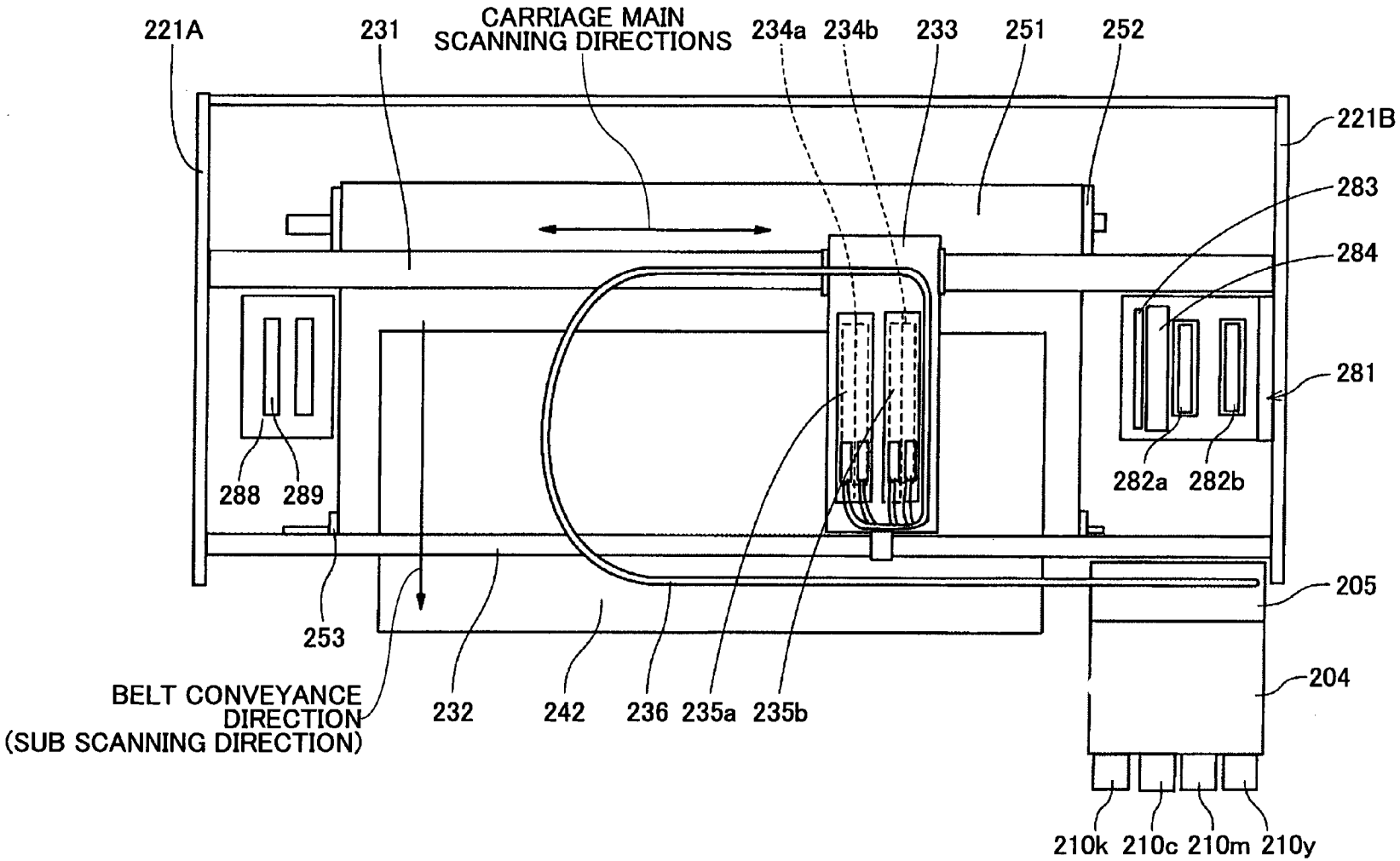
FIG. 9 is a plan view of part of the image forming apparatus according to the second embodiment of the present invention.

Next, a description is given, with reference to FIGS. 8 and 9, of an image forming apparatus including a liquid discharger that discharges liquid droplets from a liquid discharge head according to a second embodiment of the present invention. FIG. 8 is a schematic diagram for illustrating a configuration of the image forming apparatus. FIG. 9 is a plan view of part of the image forming apparatus.

This image forming apparatus is a serial type. According to this image forming apparatus, a carriage 233 is held with a primary (main) guide rod 231 and a secondary (sub) guide rod 232, which are guide members extending between left and right side plates 221A and 221B, so as to be slidable in the main scanning directions, and the carriage 233 is caused to move and scan in the directions indicated by double-headed arrow in FIG. 9 (carriage main scanning directions) by a main scanning motor (not graphically illustrated) through a timing belt.

Recording heads 234*a* and 234*b* for discharging ink droplets of yellow (Y), cyan (C), magenta (M), and black (K) colors are attached to the carriage 233 with their multiple nozzles being arranged in arrays in the sub scanning direction perpendicular to the main scanning direction and their nozzle surfaces (discharge surfaces) facing downward so that ink droplets are discharged downward. (The recording heads 234*a* and 234*b* may be collectively referred to by reference numeral "234" when no distinction is made therebetween.) Each recording head 234 is formed of a liquid discharge head according to the present invention, which may be the one described in the first embodiment.

Each recording head 234 has two nozzle arrays. One nozzle array of the recording head 234*a* discharges liquid droplets of black (K), and the other nozzle array of the recording head 234*a* discharges liquid droplets of cyan (C). One nozzle array of the recording head 234*b* discharges liquid droplets of magenta (M), and the other nozzle array of the recording head 234*b* discharges liquid droplets of yellow (Y).

Further, head tanks 235*a* and 235*b* for supplying color inks to the nozzle arrays of the recording heads 234*a* and 234*b*, respectively, are provided on the carriage 233. (The head tanks 235*a* and 235*b* may be collectively referred to by reference numeral "235" when no distinction is made therebetween.) The color inks are supplied from corresponding ink cartridges 210*k*, 210*c*, 210*m*, and 210*y*, which are detachably attached to a cartridge loading part 204, to the corresponding head tanks 235 through corresponding supply tubes 236 by a supply pump unit 205.

On the other hand, as a paper feed part for feeding paper 242 stacked on a paper stacking part (platen) 241 of a paper feed tray 202, the image forming apparatus includes a semi-lunar roller (paper feed roller) 243 that separates and feeds sheets of the paper 242 one by one from the paper stacking part 241 and a separation pad 244 formed of a material having a large coefficient of friction and disposed opposite the paper feed roller 243. The separation pad 244 is urged toward the paper feed roller 243 side.

Further, the image forming apparatus includes a guide member 245 that guides the paper 242, a counter roller 246, a conveyance guide member 247, and a pressing member 248 including an edge pressure roller 249 in order to feed the paper 242 fed from the paper feed part to a position below the recording heads 234. Further, the image forming apparatus also includes a conveyor belt 251 serving as a conveyor part for conveying the fed paper 242 in a position opposing the recording heads 234 by having the fed paper 242 electrostatically attracted and adhered thereto.

This conveyor belt 251 is an endless belt, and is engaged with and provided between a conveyor roller 252 and a tension roller 253 so as to rotate in a belt conveyance direction (sub scanning direction) (FIG. 9). Further, the image forming apparatus includes a charging roller 256 serving as a charger for charging the surface of the conveyor belt 251. The charging roller 256 is disposed in contact with the surface layer of the conveyor belt 251 so as to be rotated by the rotation of the conveyor belt 251. The conveyor belt 251 is caused to rotate in the belt conveyance direction of FIG. 9 by the conveyor roller 252 being rotated by a sub scanning motor (not graphically illustrated) through a timing belt.

The image forming apparatus further includes a separation claw 261 for separating the paper 242 from the conveyor belt 251, a paper output roller 262, and a paper output roller 263 as a paper output part for outputting (ejecting) the paper 242 subjected to recording with the recording heads 234. The image forming apparatus also includes a paper output tray 203 below the paper output roller 262.

The image forming apparatus includes a duplex unit 271 detachably attached to the rear part of an apparatus main body 201. The duplex unit 271 takes in the paper 242 returned by the reverse rotation of the conveyor belt 251. Then, the duplex unit 271 reverses the paper 242, and feeds the reversed paper 242 again into between the counter roller 246 and the conveyor belt 251. The upper surface of the duplex unit 271 serves as a manual feed tray 272.

Further, as shown in FIG. 9, a maintenance and recovery mechanism 281 including a recovery part for maintaining and restoring the nozzle status of the recording heads 234 is disposed in one of non-printing areas in the scanning directions of the carriage 233.

The maintenance and recovery mechanism 281 includes cap members (hereinafter referred to as "caps") 282*a* and 282*b* for capping the nozzle surfaces of the recording heads

234*a* and 234*b*, respectively, a wiper blade 283 serving as a blade member for wiping the nozzle surfaces, and a blank discharge (flushing) reception member 284 that receives liquid droplets at the time of flushing or discharging liquid droplets that do not contribute to recording in order to discharge recording liquid with increased viscosity.

Further, as shown in FIG. 9, an ink collection unit (blank ejection receiver) 288, serving as a liquid collection container that receives liquid droplets at the time of flushing or discharging liquid droplets that do not contribute to recording in order to discharge recording liquid with increased viscosity during recording, is disposed in the other one of the non-printing areas in the scanning directions of the carriage 233. The blank ejection receiver 288 includes openings 289 elongated along the directions of the nozzle arrays of the recording heads 234.

According to the image forming apparatus thus configured, sheets of the paper 242 are separated and fed one by one from the paper feed tray 202. The paper 242 fed upward in a substantially vertical direction is guided by the guide 245 to be conveyed, held between the conveyor belt 251 and the counter roller 246. Further, the paper 242 has its leading edge guided by the conveyance guide member 247 to be pressed against the conveyor belt 251 by the edge pressure roller 249, so that the conveying direction of the paper 242 is changed by substantially 90°.

At this point, positive output and negative output are alternately applied repeatedly, that is, an alternating voltage is applied, to the charging roller 256, so that the conveyor belt 251 has alternating charging voltage patterns, that is, the conveyor belt 251 is charged so as to have alternate belt-like patterns, each of a predetermined width, of positively charged parts and negatively charged parts in the sub scanning direction that is the rotating direction. When the paper 242 is fed onto this conveyor belt 251 charged alternately positively and negatively, the paper 242 is attracted and adhered to the conveyor belt 251, and is conveyed in the sub scanning direction by the rotation of the conveyor belt 251.

Then, the recording heads 234 are driven in accordance with an image signal while moving the carriage 233, thereby discharging ink droplets onto the paper 242 at rest and performing one line's worth of recording. Then, after conveying the paper 242 by a predetermined amount, the next line is recorded. In response to reception of a recording end signal or a signal indicating that the trailing edge of the paper 242 has reached a recording area, the recording operation ends and the paper 242 is output onto the paper output tray 203.

Such a serial-type image forming apparatus can also record a high-quality image at high speed by having an elongated liquid discharge head according to the present invention.

In the above-described embodiment, a liquid discharger according to the present invention is applied to an image forming apparatus having a printer configuration. However, a liquid discharger according to the present invention may also be applied to image forming apparatuses such as multifunction machines having the functions of a printer, a facsimile machine, and a copier, and to image forming apparatuses using liquid such as recording liquid other than ink and a fixing solution.

According to one embodiment of the present invention, there is provided a liquid discharge head configured to discharge liquid including a silicone resin layer formed on the side of a surface from which the liquid is discharged, the silicone resin layer serving as a water-repellent layer, wherein the number of water-repellent molecular chains is greater than or equal to half of the number of hydrophilic molecular chains on the surface of the silicone resin layer, and the number of hydrophilic molecular chains in the silicone resin layer is greater on the side of the interface with a base material on which the silicone resin layer is formed than on the surface of the silicone resin layer.

The above-described liquid discharge head has good water repellency in the case of discharging liquid, in particular liquid containing fluorochemical.

According to one embodiment of the present invention, there is provided a liquid discharge head configured to discharge liquid including a silicone resin layer formed on the side of a surface from which the liquid is discharged, the silicone resin layer serving as a water-repellent layer, wherein the number of molecular chains having molecular components of a mass number period of 74 is greater than or equal to half of the number of molecular chains having molecular components of a mass number period of 60 on the surface of the silicone resin layer, and the number of molecular chains having the molecular components of a mass number period of 60 in the silicone resin layer is greater on the side of the interface with a base material on which the silicone resin layer is formed than on the surface of the silicone resin layer.

The above-described liquid discharge head has good water repellency in the case of discharging liquid, in particular liquid containing fluorochemical.

According to one embodiment of the present invention, there is provided a liquid discharger configured to discharge a liquid droplet from a liquid discharge head, wherein the liquid discharge head is any of the above-described liquid discharge heads.

According to one embodiment of the present invention, there is provided an image forming apparatus configured to form an image by discharging a liquid droplet from a liquid discharge head, wherein the liquid discharge head is any of the above-described liquid discharge heads.

Thus, since a liquid discharger and an image forming apparatus according to the present invention includes a liquid discharge head according to the present invention, the liquid discharger and the image forming apparatus can excellently perform liquid discharging, in particular, in the case of discharging liquid containing fluorochemical.

The present invention is not limited to the specifically disclosed embodiments, and variations and modifications may be made without departing from the scope of the present invention.

The present applications is based on Japanese Priority Patent Applications No. 2006-114092, filed on Apr. 18, 2006, and No. 2007-046234, filed on Feb. 26, 2007, the entire contents of which are hereby incorporated by reference.

What is claimed is:

1. A liquid discharge head configured to discharge liquid, comprising:

a silicone resin layer formed on a side of a surface from which the liquid is discharged, the silicone resin layer serving as a water-repellent layer, wherein a number of water-repellent molecular chains on a surface of the silicone resin layer is greater than or equal to a half of a number of hydrophilic molecular chains on the surface of the silicone resin layer, and the number of the hydrophilic molecular chains in the silicone resin layer is greater on a side of an interface with a base material on which the silicone resin layer is formed than on the surface of the silicone resin layer.

2. The liquid discharge head as claimed in claim 1, wherein the water-repellent molecular chains have one of a fluorinated hydrocarbon group, a polydimethylsiloxane group, and a hydrocarbon group.

3. The liquid discharge head as claimed in claim 1, wherein the silicone resin layer is less than 10 μm in thickness.

4. The liquid discharge head as claimed in claim 1, wherein the base material on which the silicone resin layer is formed is formed of a metal material.

5. The liquid discharge head as claimed in claim 1, wherein the base material on which the silicone resin layer is formed is formed of a resin material.

6. The liquid discharge head as claimed in claim 1, wherein the liquid contains fluorochemical.

7. A liquid discharger configured to discharge a liquid droplet from a liquid discharge head, wherein the liquid discharge head is as set forth in claim 1.

8. An image forming apparatus configured to form an image by discharging a liquid droplet from a liquid discharge head, wherein the liquid discharge head is as set forth in claim 1.

9. The image forming apparatus as claimed in claim 8, wherein the liquid discharge head is configured to discharge a recording liquid having a surface tension of 15 to 30 mN/m.

10. The image forming apparatus as claimed in claim 8, wherein the liquid discharge head is configured to discharge a liquid containing a pigment as a coloring material.

11. A liquid discharge head configured to discharge liquid, comprising:

a silicone resin layer formed on a side of a surface from which the liquid is discharged, the silicone resin layer serving as a water-repellent layer, wherein a number of molecular chains having molecular components of a mass number period of 74 is greater than or equal to a half of a number of molecular chains having molecular components of a mass number period of 60 on a surface of the silicone resin layer, and the number of the molecular chains having the molecular components of the mass number period of 60 in the silicone resin layer is greater on a side of an interface with a base material on which the silicone resin layer is formed than on the surface of the silicone resin layer.

12. The liquid discharge head as claimed in claim 11, wherein the silicone resin layer is less than 10 μm in thickness.

13. The liquid discharge head as claimed in claim 11, wherein the base material on which the silicone resin layer is formed is formed of a metal material.

14. The liquid discharge head as claimed in claim 11, wherein the base material on which the silicone resin layer is formed is formed of a resin material.

15. The liquid discharge head as claimed in claim 11, wherein the liquid contains fluorochemical.

16. A liquid discharger configured to discharge a liquid droplet from a liquid discharge head, wherein the liquid discharge head is as set forth in claim 11.

17. An image forming apparatus configured to form an image by discharging a liquid droplet from a liquid discharge head, wherein the liquid discharge bead is as set forth in claim 11.

18. The image forming apparatus as claimed in claim 17, wherein the liquid discharge head is configured to discharge a recording liquid having a surface tension of 15 to 30 mN/m.

19. The image forming apparatus as claimed in claim 17, wherein the liquid discharge head is configured to discharge a liquid containing a pigment as a coloring material.

* * * * *